US011701558B2

(12) United States Patent
Morales et al.

(10) Patent No.: US 11,701,558 B2
(45) **Date of Patent: *Jul. 18, 2023**

(54) CLUB HEADS HAVING REINFORCED CLUB HEAD FACES AND RELATED METHODS

(71) Applicant: KARSTEN MANUFACTURING CORPORATION, Phoenix, AZ (US)

(72) Inventors: Eric J. Morales, Laveen, AZ (US); Ryan M. Stokke, Anthem, AZ (US); Eric V. Cole, Phoenix, AZ (US); Cory S. Bacon, Cave Creek, AZ (US); Travis D. Milleman, Portland, OR (US); Jacob T. Clarke, Apex, NC (US); Calvin Wang, Chandler, AZ (US); Xiaojian Chen, Phoenix, AZ (US); Martin R. Jertson, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 58 days.

This patent is subject to a terminal disclaimer.

(21) Appl. No.: 17/150,830

(22) Filed: Jan. 15, 2021

(65) Prior Publication Data

US 2021/0138321 A1 May 13, 2021

Related U.S. Application Data

(63) Continuation of application No. 16/282,020, filed on Feb. 21, 2019, now Pat. No. 10,918,919, which is a (Continued)

(51) Int. Cl.
*A63B 53/04* (2015.01)
*A63B 53/06* (2015.01)
(Continued)

(52) U.S. Cl.
CPC ..... *A63B 53/0475* (2013.01); *A63B 53/047* (2013.01); *A63B 53/06* (2013.01);
(Continued)

(58) Field of Classification Search
CPC ... A63B 53/0475; A63B 53/047; A63B 53/06; A63B 60/02; A63B 60/54;
(Continued)

(56) References Cited

U.S. PATENT DOCUMENTS 1,359,220 A 11/1920 Beamer
5,409,229 A 4/1995 Schmidt et al.
(Continued)

FOREIGN PATENT DOCUMENTS

CN 104740854 7/2015
JP H06-023553 3/1994
(Continued)

OTHER PUBLICATIONS

International Search Report dated Jul. 27, 2015 from corresponding PCT Application No. PCT/US2015/030076, filed May 11, 2015.
(Continued)

*Primary Examiner* — Jeffrey S Vanderveen

(57) ABSTRACT

Some embodiments include club heads having reinforced club head faces. In one example, the club face comprises a reinforcement element such as a looped rib positioned on a rear surface of the club face to provide reinforcement. The club head further comprises an undercut that extends along the entire perimeter of the club face to provide increased club face bending. The combination of the reinforcement element and the undercut reinforces the club head while permitting the club face to bend. Other embodiments of related club heads and methods are also disclosed.

20 Claims, 11 Drawing Sheets

Related U.S. Application Data continuation of application No. 15/644,653, filed on Jul. 7, 2017, now Pat. No. 10,258,843, which is a continuation-in-part of application No. 15/170,593, filed on Jun. 1, 2016, now Pat. No. 10,905,926, which is a continuation-in-part of application No. 14/710,236, filed on May 12, 2015, now Pat. No. 10,905,925, said application No. 15/644,653 is a continuation-in-part of application No. 15/628,639, filed on Jun. 20, 2017, now Pat. No. 10,888,743, which is a continuation-in-part of application No. 14/920,484, filed on Oct. 22, 2015, now abandoned, and a continuation-in-part of application No. 14/920,480, filed on Oct. 22, 2015, now Pat. No. 10,688,350.

(60) Provisional application No. 62/521,998, filed on Jun. 19, 2017, provisional application No. 62/359,450, filed on Jul. 7, 2016, provisional application No. 62/280,035, filed on Jan. 18, 2016, provisional application No. 62/266,074, filed on Dec. 11, 2015, provisional application No. 62/169,089, filed on Jun. 1, 2015, provisional application No. 62/146,783, filed on Apr. 13, 2015, provisional application No. 62/101,926, filed on Jan. 9, 2015, provisional application No. 62/023,819, filed on Jul. 11, 2014, provisional application No. 61/994,029, filed on May 15, 2014, provisional application No. 62/484,529, filed on Apr. 12, 2017, provisional application No. 62/462,250, filed on Feb. 22, 2017, provisional application No. 62/436,019, filed on Dec. 19, 2016, provisional application No. 62/352,495, filed on Jun. 20, 2016, provisional application No. 62/206,152, filed on Aug. 17, 2015, provisional application No. 62/131,739, filed on Mar. 11, 2015, provisional application No. 62/105,460, filed on Jan. 20, 2015, provisional application No. 62/105,464, filed on Jan. 20, 2015, provisional application No. 62/068,232, filed on Oct. 24, 2014, provisional application No. 62/206,152, filed on Aug. 17, 2015.

(51) Int. Cl.
*A63B 60/54* (2015.01)
*A63B 60/02* (2015.01)
*A63B 60/52* (2015.01)

(52) U.S. Cl.
CPC ..... *A63B 60/02* (2015.10); *A63B 60/54* (2015.10); *A63B 53/0408* (2020.08); *A63B 53/0416* (2020.08); *A63B 53/0445* (2020.08); *A63B 53/0454* (2020.08); *A63B 53/0458* (2020.08); *A63B 60/52* (2015.10); *A63B 2053/0491* (2013.01); *A63B 2209/00* (2013.01); *Y10T 29/49828* (2015.01)

(58) Field of Classification Search
CPC ..... A63B 53/0408; A63B 53/0416; A63B 53/0445; A63B 53/0454; A63B 53/0458; A63B 60/52; A63B 2053/0491; A63B 2209/00; A63B 53/0433; A63B 60/42; A63B 2209/10; A63B 60/00; A63B 60/50; Y10T 29/49828
See application file for complete search history.

(56) References Cited

U.S. PATENT DOCUMENTS 5,586,947 A 12/1996 Hutin
5,595,552 A 1/1997 Wright et al.
5,643,099 A 7/1997 Solheim
5,649,872 A 7/1997 Antonious
5,695,411 A 12/1997 Wright et al.
5,766,092 A 6/1998 Mimer
5,873,795 A 2/1999 Wozny et al.
5,971,868 A * 10/1999 Kosmatka ..... A63B 69/3635 473/324
6,319,149 B1 * 11/2001 Lee ..... A63B 53/04 473/409
6,348,013 B1 2/2002 Kosmatka
6,379,265 B1 4/2002 Hirakawa et al.
6,533,679 B1 3/2003 McCabe et al.
6,572,491 B2 6/2003 Hasebe
6,616,546 B2 9/2003 Cho
6,780,123 B2 8/2004 Hasebe
6,849,005 B2 2/2005 Rife
6,971,961 B2 12/2005 Chen
6,979,270 B1 * 12/2005 Allen ..... A63B 53/0466 473/290
6,997,820 B2 2/2006 Willett et al.
RE39,178 E 7/2006 Allen
7,083,530 B2 8/2006 Wahl et al.
7,192,364 B2 3/2007 Long
7,207,900 B2 4/2007 Nicolette et al.
7,232,381 B2 6/2007 Imamoto et al.
7,351,164 B2 4/2008 Schweigert et al.
7,377,861 B2 5/2008 Tateno
7,387,579 B2 6/2008 Lin et al.
7,390,270 B2 6/2008 Roberts et al.
7,431,668 B2 10/2008 Tateno
7,435,191 B2 10/2008 Tateno
7,448,964 B2 11/2008 Schweigert et al.
7,455,597 B2 11/2008 Matsunaga
7,469,321 B2 12/2008 Heller
7,470,200 B2 12/2008 Sanchez
7,503,853 B2 4/2009 Matsunaga
7,513,836 B2 4/2009 Matsunaga
7,588,504 B2 9/2009 Matsunaga
7,749,102 B2 7/2010 Nakamura
7,762,907 B2 7/2010 Rice
7,771,291 B1 * 8/2010 Willett ..... A63B 53/0466 473/345
7,798,915 B2 9/2010 Matsunaga
8,012,040 B2 9/2011 Takechi
8,043,165 B2 10/2011 Galloway
8,109,842 B2 2/2012 Matsunaga
8,182,365 B2 5/2012 Wada
8,262,495 B2 * 9/2012 Stites ..... A63B 53/04 473/226
8,277,337 B2 10/2012 Shimazaki
8,353,785 B2 1/2013 Ines
8,535,177 B1 9/2013 Wahl et al.
8,647,217 B2 2/2014 Nishio
8,651,975 B2 2/2014 Soracco
8,657,701 B2 2/2014 Stites et al.
8,657,703 B2 2/2014 Wada
8,690,710 B2 4/2014 Nicolette et al.
8,870,681 B2 10/2014 Yamamoto
8,932,149 B2 1/2015 Oldknow
8,986,133 B2 3/2015 Bennett et al.
9,044,653 B2 6/2015 Wahl
9,079,078 B2 7/2015 Greensmith et al.
9,079,081 B2 7/2015 Shimazaki
9,089,747 B2 7/2015 Boyd
9,089,749 B2 7/2015 Burnett et al.
9,265,995 B2 2/2016 Wahl
9,415,280 B2 8/2016 Stokke et al.
9,522,311 B2 12/2016 Doi et al.
9,597,562 B2 3/2017 Dipert et al.
9,669,271 B2 6/2017 Soracco et al.
9,675,852 B2 6/2017 Westrum
10,688,350 B2 6/2020 Jertson
2002/0183134 A1 * 12/2002 Allen ..... A63B 60/00 473/345
2005/0090332 A1 * 4/2005 Burrows ..... A63B 53/047 473/345
2007/0015601 A1 * 1/2007 Tsunoda ..... A63B 60/00 473/346

(56) References Cited

U.S. PATENT DOCUMENTS

| | | | | |
|---|---|---|---|---|
| 2008/0004129 | A1* | 1/2008 | Lin | A63B 60/00 473/332 |
| 2008/0004130 | A1* | 1/2008 | Lin | A63B 53/0466 473/342 |
| 2009/0017934 | A1 | 1/2009 | Stites | |
| 2009/0023513 | A1 | 1/2009 | Shibata et al. | |
| 2009/0029796 | A1* | 1/2009 | Mergy | A63B 53/047 29/527.3 |
| 2010/0041489 | A1 | 2/2010 | Elmer | |
| 2010/0197425 | A1* | 8/2010 | Clausen | A63B 53/04 473/346 |
| 2010/0273565 | A1* | 10/2010 | Stites | A63B 53/047 473/282 |
| 2010/0279795 | A1* | 11/2010 | Nicolette | A63B 53/047 473/350 |
| 2011/0183776 | A1 | 7/2011 | Breier et al. | |
| 2012/0064994 | A1* | 3/2012 | Wada | A63B 53/0466 473/346 |
| 2012/0322577 | A1* | 12/2012 | Wada | A63B 53/0466 473/345 |
| 2013/0109500 | A1 | 5/2013 | Boyd et al. | |
| 2013/0281229 | A1 | 10/2013 | Su | |
| 2013/0344990 | A1* | 12/2013 | Slaughter | A63B 53/047 473/349 |
| 2014/0329615 | A1 | 11/2014 | Roberts et al. | |
| 2015/0011326 | A1 | 1/2015 | Su | |
| 2015/0024864 | A1* | 1/2015 | Jertson | A63B 60/02 473/291 |
| 2015/0165285 | A1 | 6/2015 | Stites et al. | |
| 2015/0328506 | A1* | 11/2015 | Morales | A63B 60/54 473/331 |
| 2016/0271461 | A1* | 9/2016 | Morales | A63B 60/54 |
| 2017/0095710 | A1* | 4/2017 | Henrikson | A63B 53/0466 |
| 2017/0113107 | A1 | 4/2017 | Sugimoto et al. | |
| 2017/0304691 | A1* | 10/2017 | Morales | A63B 60/54 |
| 2018/0178094 | A1* | 6/2018 | Morales | A63B 53/0475 |

FOREIGN PATENT DOCUMENTS

| | | | |
|---|---|---|---|
| JP | H09215793 | A | 8/1997 |
| JP | H10295860 | A | 11/1998 |
| JP | 2001087430 | | 4/2001 |
| JP | 2001334004 | A | 12/2001 |
| JP | 2002102396 | A | 4/2002 |
| JP | 2002331051 | A | 11/2002 |
| JP | 2003062132 | | 3/2003 |
| JP | 3399896 | B2 | 4/2003 |
| JP | 2006212066 | | 8/2006 |
| JP | 2008054985 | | 3/2008 |
| JP | 2009028539 | A | 2/2009 |
| JP | 2010167131 | | 8/2010 |
| JP | 2010252897 | A | 11/2010 |
| JP | 4608060 | B2 | 1/2011 |
| JP | 2011030837 | A | 2/2011 |
| JP | 2010017475 | | 10/2013 |
| JP | 2014195584 | | 8/2015 |
| WO | 2004041372 | | 2/2006 |

OTHER PUBLICATIONS

Written Opinion dated Jul. 27, 2015 from corresponding PCT application No. PCT/US2015/030076, filed May 11, 2015.

Http://www.golfworks.com/product.asp_Q_pn_E_MA0225_A_Maltby+DBM+Forged+Iron_Heads_A_c2p_E_cs, "Maltby Dbm Forged Head", Accessed Oct. 15, 2015.

Http://www.golfalot.com/equipment-news/taylormade-sldr-irons-2857.aspx, "Taylor Made Sldr Irons", Published May 5, 2014, Accessed Oct. 15, 2015.

Http://www.golfwrx.com/322138/you-can-see-inside-cobras-king-ltd-drivers-and-fairway-woods/, "You can see inside Cobra's King Ltd drivers and fairway woods". Zak Kozuchowski, Accessed on Oct. 15, 2015.

International Search Report and Written Opinion from corresponding PCT Application No. PCT/US2015/056933, entitled "Golf Club Hads With Energy Storage Characteristics," filed Oct. 22, 2015.

* cited by examiner

1002

1200

100

CLUB HEADS HAVING REINFORCED CLUB HEAD FACES AND RELATED METHODS

CROSS REFERENCE

This is a continuation U.S. patent application Ser. No. 16/282,020, filed on Feb. 21, 2019, which is a continuation of U.S. patent application Ser. No. 15/644,653, filed on Jul. 7, 2017, and is issued as U.S. Pat. No. 10,258,843 on Apr. 16, 2019, which claims the priority of U.S. Provisional Patent Appl. No. 62/521,998, filed on Jun. 19, 2017, and U.S. Provisional Patent Appl. No. 62/359,450, filed Jul. 7, 2016, and is a continuation-in-part of U.S. patent application Ser. No. 15/170,593, filed on Jun. 1, 2016, which claims the priority of U.S. Provisional Patent Appl. No. 62/280,035, filed Jan. 18, 2016, U.S. Provisional Patent Appl. No. 62/266,074, filed on Dec. 11, 2015, and U.S. Provisional Patent Appl. No. 62/169,089, filed on Jun. 1, 2015, and is a continuation-in-part of U.S. application Ser. No. 14/710,236, filed May 12, 2015, which claims the priority of U.S. Provisional Patent Appl. No. 62/146,783, filed Apr. 13, 2015, U.S. Provisional Patent Appl. No. 62/101,926, filed on Jan. 9, 2015, U.S. Provisional Patent Appl. No. 62/023,819, filed on Jul. 11, 2014, and U.S. Provisional Patent Appl. No. 61/994,029, filed on May 15, 2014.

U.S. patent application Ser. No. 15/644,653 is a continuation-in-part of U.S. patent application Ser. No. 15/628,639, filed Jun. 20, 2017, which claims the priority of U.S. Provisional Patent Appl. No. 62/484,529, filed on Apr. 12, 2017, U.S. Provisional Patent Appl. No. 62/462,250, filed on Feb. 22, 2017, U.S. Provisional Patent Appl. No. 62/436,019, filed on Dec. 19, 2016, and U.S. Provisional Patent Appl. No. 62/352,495, filed on Jun. 20, 2016, and is a continuation in part of U.S. patent application Ser. No. 14/920,484, filed on Oct. 22, 2015, and is a continuation in part of U.S. patent application Ser. No. 14/920,480, filed on Oct. 22, 2015, and is issued as U.S. Pat. No. 10,688,350 on Jun. 23, 2020, both of which claim the priority of U.S. Provisional Patent Appl. No. 62/206,152, filed Aug. 17, 2015, U.S. Provisional Patent Appl. No. 62/131,739, filed on Mar. 11, 2015, U.S. Provisional Patent Appl. No. 62/105,460, filed on Jan. 20, 2015, U.S. Provisional Patent Appl. No. 62/105,464, filed on Jan. 20, 2015, and U.S. Provisional Patent Appl. No. 62/068,232, filed on Oct. 24, 2014. The contents of all of the above-described disclosures are incorporated fully herein by reference in their entirety.

TECHNICAL FIELD

This disclosure relates generally to sports equipment and relates more particularly to golf club heads and related methods.

BACKGROUND

Various characteristics of a golf club can affect the performance of the golf club. For example, the center of gravity, the moment of inertia, and the coefficient of restitution of the club head of the golf club are each characteristics of a golf club that can affect performance.

The center of gravity and moment of inertia of the club head of the golf club are functions of the distribution of mass of the club head. In particular, distributing mass of the club head to be closer to a sole of the club head, farther from a face of the club head, and/or closer to toe and heel ends of the club head can alter the center of gravity and/or the moment of inertia of the club head. For example, distributing mass of the club head to be closer to the sole of the club head and/or farther from the face of the club head can increase a flight angle of a golf ball struck with the club head. Meanwhile, increasing the flight angle of a golf ball can increase the distance the golf ball travels. Further, distributing mass of the club head to be closer to the toe and/or heel ends of the club head can affect the moment of inertia of the club head, which can alter the forgiveness of the golf club.

Further, the coefficient of restitution of the club head of the golf club can be a function of at least the flexibility of the face of the club head. Meanwhile, the flexibility of the face of the club head can be a function of the geometry (e.g., height, width, and/or thickness) of the face and/or the material properties (e.g., Young's modulus) of the face. That is, maximizing the height and/or width of the face, and/or minimizing the thickness and/or Young's modulus of the face, can increase the flexibility of the face, thereby increasing the coefficient of restitution of the club head; and increasing the coefficient of restitution of the club head of the golf club, which is essentially a measure of the efficiency of energy transfer from the club head to a golf ball, can increase the distance the golf ball travels after impact, decrease the spin of the golf ball, and/or increase the ball speed of the golf ball.

However, although thinning the face of the club head can permit mass from the face to be redistributed to other parts of the club head and can make the face more flexible, thinning the face of the club head also can result in increased bending in the face to the point of buckling and failure. Accordingly, devices and methods for preventing the face of a club head from buckling as the face of the club head is thinned are needed.

BRIEF DESCRIPTION OF THE DRAWINGS

To facilitate further description of the embodiments, the following drawings are provided in which.

Figure 1:
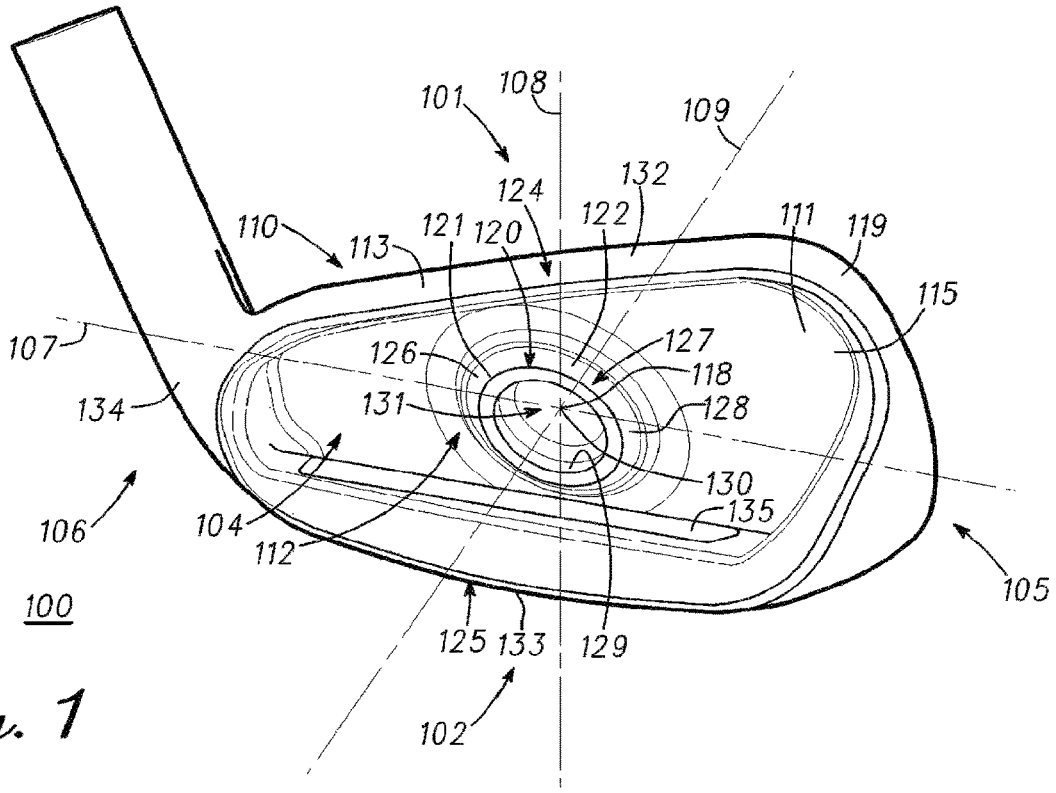
FIG. 1 illustrates a top, rear, toe side view of a club head, according to an embodiment.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements mechanically and/or otherwise. Two or more mechanical elements may be mechanically coupled together, but not be electrically or otherwise coupled together. Coupling may be for any length of time, e.g., permanent or semi-permanent or only for an instant.

"Mechanical coupling" and the like should be broadly understood and include mechanical coupling of all types.

The absence of the word "removably," "removable," and the like near the word "coupled," and the like does not mean that the coupling, etc. in question is or is not removable.

DESCRIPTION

Some embodiments include a golf club head. The golf club head comprises a top end and a bottom end opposite the top end, a front end and a rear end opposite the front end, and a toe end and a heel end opposite the toe end. Further, the golf club head comprises a face element. The face element comprises a face surface located at the front end, and the face surface comprises a face center and a face perimeter. Also, the face element comprises a rear surface located at the rear end and being approximately opposite to the face surface, and the rear surface comprises a rear center approximately opposite the face center and a rear perimeter. Further still, the golf club head comprises a reinforcement device located at the rear surface. In these embodiments, an x-axis extends approximately parallel to the face surface and intersects the rear center; a y-axis extends approximately parallel to the face surface, extends approximately perpendicular to the x-axis, and intersects the rear center; and a z-axis extends approximately perpendicular to the face surface, extends approximately perpendicular to the x-axis and the y-axis, and intersects the rear center. Further, the x-axis extends through the toe end and the heel end and equidistant between the top end and the bottom end; the y-axis extends through the top end and the bottom end and equidistant between the toe end and the heel end; and the z-axis extends through the front end and the rear end and equidistant (i) between the toe end and the heel end and (ii) between the top end and the rear end. Further in these embodiments, the reinforcement device comprises a reinforcement element comprising a geometric center approximately located at the z-axis, the reinforcement element extends out from the rear surface toward the rear end and away from the front end, and the reinforcement element comprises a looped rib. Meanwhile, the face surface can be nearer to the rear surface proximal to the face center than proximal to the face perimeter.

Other embodiments include a golf club head. In some embodiments, the golf club head comprises an iron-type golf club head. The golf club head comprises a top end and a bottom end opposite the top end, a front end and a rear end opposite the front end, and a toe end and a heel end opposite the toe end. Further, the golf club head comprises a face element. The face element comprises a face surface located at the front end, and the face surface comprises a face center and a face perimeter. Also, the face element comprises a rear surface located at the rear end and being approximately opposite to the face surface, and the rear surface comprises a rear center approximately opposite the face center and a rear perimeter. Further still, the golf club head comprises a reinforcement device located at the rear surface. Even further still, the golf club head comprises a perimeter wall element (i) extending out from the rear surface toward the rear end and away from the front end and (ii) extending entirely around the perimeter of the rear surface. The perimeter wall element comprises a first perimeter wall portion extending along the perimeter of the rear surface at the top end and a second perimeter wall portion extending along the perimeter of the rear surface at the bottom end. In these embodiments, an x-axis extends approximately parallel to the face surface and intersects the rear center; a y-axis extends approximately parallel to the face surface, extends approximately perpendicular to the x-axis, and intersects the rear center; and a z-axis extends approximately perpendicular to the face surface, extends approximately perpendicular to the x-axis and the y-axis, and intersects the rear center. Further, the x-axis extends through the toe end and the heel end and equidistant between the top end and the bottom end; the y-axis extends through the top end and the bottom end and equidistant between the toe end and the heel end; and the z-axis extends through the front end and the rear end and equidistant (i) between the toe end and the heel end and (ii) between the top end and the rear end. Further in these embodiments, the reinforcement device comprises a reinforcement element comprising a geometric center approximately located at the z-axis, the reinforcement element extends out from the rear surface toward the rear end and away from the front end, and the reinforcement element comprises a closed circular looped rib. Also, the golf club head comprises an iron-type golf club head, a center thickness from the face center to the rear center is less than or equal to approximately 0.203 centimeters, and at least part of the second perimeter wall portion is thinner than is the face element proximal to the face perimeter.

Some embodiments further include an insert that at least partially fills in a cavity of the reinforcement element that is formed by the looped rib. In some embodiments, the cavity can be a central cavity. The central cavity can also be partially covered by a badge. The badge can be separate from the insert or integral with the insert. In other embodiments, the badge can be integral with the reinforcement element. The insert can be of a lightweight material of about 3 g or less and may not significantly affect the center of gravity of the swing of the golf club head. In alternative embodiments, the insert can weigh more than 3 g, such as between 5 g and 10 g, and may contribute to the swing weight or the center of gravity of the club head.

Further embodiments include a vibration attenuating feature disposed on the rear surface of the golf club head to reduce noise, to produce a more desirable sound, and to reduce vibration of the golf club head. The vibration attenuating feature can be composed of any material or composition capable of damping or removing vibrations such as damping foil, rubber, or pressure sensitive viscoelastic acrylic polymer. The vibration attenuating feature may be pressure sensitive, leading to lessening or removal of vibration from the golf club head when a golf ball is struck. The viscoelastic damping feature provides the golf club head with a more desirable sound combined with getting greater performance in a thin-face golf club head. The vibration attenuating feature is at least partially applied to the rear surface of the golf club head. The vibration attenuating feature can also be applied to the reinforcement element. The vibration attenuating feature may be further applied to all or part of the cavity of the reinforcement element. The cavity can be a central cavity. The central cavity of the rear surface can also be partially covered by the vibration attenuating feature. The central cavity can also be partially covered by a badge, and the vibration attenuating feature can be disposed beneath the badge.

Further embodiments include a method of providing a golf club head. The method can comprise:

providing a face element comprising: (i) a face surface located at the front end and comprising a face center and a face perimeter; and (ii) a rear surface located at the rear end and being approximately opposite to the face surface, the rear surface comprising a rear center approximately opposite the face center and a rear perimeter; and providing a reinforcement device at the rear surface. In these embodiments, the golf club head comprises a top end and a bottom end opposite the top end, a front end and a rear end opposite the front end, and a toe end and a heel end opposite the toe end. Further, an x-axis extends approximately parallel to the face surface and intersects the rear center; a y-axis extends approximately parallel to the face surface, extends approximately perpendicular to the x-axis, and intersects the rear center; and a z-axis extends approximately perpendicular to the face surface, extends approximately perpendicular to the x-axis and the y-axis, and intersects the rear center. Further still, the x-axis extends through the toe end and the heel end and equidistant between the top end and the bottom end; the y-axis extends through the top end and the bottom end and equidistant between the toe end and the heel end; and the z-axis extends through the front end and the rear end and equidistant (i) between the toe end and the heel end and (ii) between the top end and the rear end. Meanwhile, the reinforcement device comprises a reinforcement element comprising a geometric center approximately located at the z-axis, the reinforcement element extends out from the rear surface toward the rear end and away from the front end, and the reinforcement element comprises a looped rib. Also, the face surface can be nearer to the rear surface proximal to the face center than proximal to the face perimeter.

Some embodiments include a golf club. The golf club comprises a shaft and a golf club head coupled to the shaft. The golf club head comprises a top end and a bottom end opposite the top end, a front end and a rear end opposite the front end, and a toe end and a heel end opposite the toe end. Further, the golf club head comprises a face element. The face element comprises a face surface located at the front end, and the face surface comprises a face center and a face perimeter. Also, the face element comprises a rear surface located at the rear end and being approximately opposite to the face surface, and the rear surface comprises a rear center approximately opposite the face center and a rear perimeter. Further still, the golf club head comprises a reinforcement device located at the rear surface. In these embodiments, an x-axis extends approximately parallel to the face surface and intersects the rear center; a y-axis extends approximately parallel to the face surface, extends approximately perpendicular to the x-axis, and intersects the rear center; and a z-axis extends approximately perpendicular to the face surface, extends approximately perpendicular to the x-axis and the y-axis, and intersects the rear center. Further, the x-axis extends through the toe end and the heel end and equidistant between the top end and the bottom end; the y-axis extends through the top end and the bottom end and equidistant between the toe end and the heel end; and the z-axis extends through the front end and the rear end and equidistant (i) between the toe end and the heel end and (ii) between the top end and the rear end. Further in these embodiments, the reinforcement device comprises a reinforcement element comprising a geometric center approximately located at the z-axis, the reinforcement element extends out from the rear surface toward the rear end and away from the front end, and the reinforcement element comprises a looped rib. Meanwhile, the face surface can be nearer to the rear surface proximal to the face center than proximal to the face perimeter.

Figure 2:
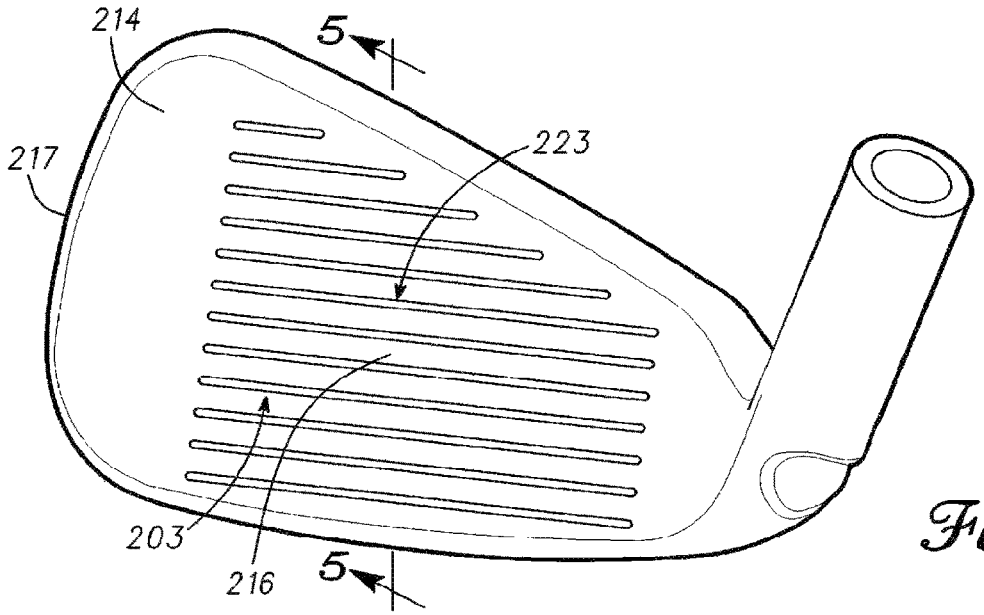
FIG. 2 illustrates a top, front, heel side view of the club head, according to the embodiment of FIG. 1.

Turning to the drawings, FIG. 1 illustrates a top, rear, toe side view of a club head 100, according to an embodiment. Meanwhile, FIG. 2 illustrates a top, front, heel side view of club head 100, according to the embodiment of FIG. 1. Club head 100 is merely exemplary and is not limited to the embodiments presented herein. Club head 100 can be employed in many different embodiments or examples not specifically depicted or described herein.

Figure 14:
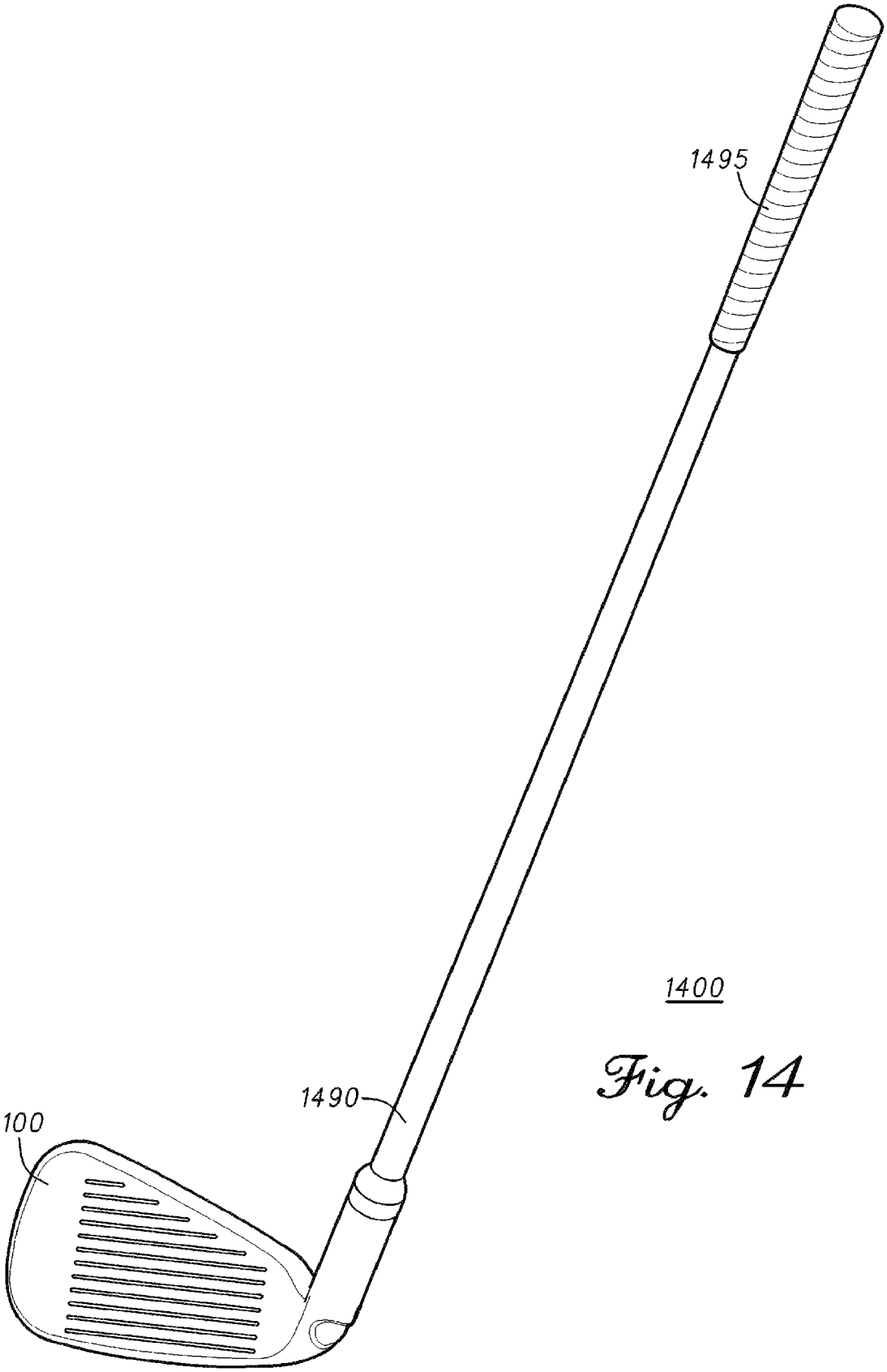
FIG. 14 illustrates a front view of a golf club, according to an embodiment.

Generally, club head 100 can comprise a golf club head. Golf club head 100 can be part of a corresponding golf club. For example, a golf club 1400 (FIG. 14) can comprise golf club head 100 coupled to a shaft 1490 and a grip 1495. Further, the golf club head can be part of a set of golf club heads, and/or the golf club can be part of a set of golf clubs. For example, club head 100 can comprise any suitable iron-type golf club head. In some embodiments, club head 100 can comprise a muscle-back iron-type golf club head or cavity-back iron-type golf club head. Nonetheless, although club head 100 is generally described with respect to a iron-type golf club head, club head 100 can comprise any other suitable type of golf club head, such as, for example, a wood-type golf club head (e.g., a driver club head, a fairway wood club head, a hybrid club head, etc.) or a putter golf club head. Generally, club head 100 can comprise any suitable materials, but in many embodiments, club head 100 comprises one or more metal materials. Notwithstanding the foregoing, the apparatus, methods, and articles of manufacture described herein are not limited in this regard.

For reference purposes, club head 100 comprises a top end 101 and a bottom end 102 opposite top end 101, a front end 203 (FIG. 2) and a rear end 104 opposite front end 203 (FIG. 2), and a toe end 105 and a heel end 106 opposite toe end 105. Also, club head 100 comprises an x-axis 107, a y-axis 108, and a z-axis 109.

Meanwhile, x-axis 107, y-axis 108, and z-axis 109 provide a Cartesian reference frame for club head 100. Accordingly, x-axis 107, y-axis 108, and z-axis 109 are perpendicular to each other. Further, x-axis 107 extends through toe end 105 and heel end 106 and is equidistant between top end 101 and bottom end 102; y-axis 108 extends through top end 101 and bottom end 102 and is equidistant between toe end 105 and heel end 106; and z-axis 109 extends through front end 203 (FIG. 2) and rear end 104 and is equidistant (i) between toe end 105 and heel end 106 and (ii) between top end 101 and rear end 102.

Club head 100 comprises a club head body 110. Club head body 110 can be solid, hollow, or partially hollow. When club head body 110 is hollow and/or partially hollow, club head body 110 can comprise a shell structure, and further, can be filled and/or partially filled with a filler material different from a material of shell structure. For example, the filler material can comprise plastic foam.

Club head body 110 comprises a face element 111 and a reinforcement device 112. In many embodiments, club head body 110 can comprise a perimeter wall element 113.

In many embodiments, face element 111 comprises a face surface 214 (FIG. 2) and a rear surface 115. Meanwhile, face surface 214 (FIG. 2) comprises a face center 216 (FIG. 2) and a face perimeter 217 (FIG. 2), and rear surface 115 comprises a rear center 118 and a rear perimeter 119. Face surface 214 (FIG. 2) can refer to a striking face or a striking plate of club head 100, and can be configured to impact a ball (not shown), such as, for example, a golf ball. In many embodiments, face surface 214 (FIG. 2) can comprise one or more scoring lines 223 (FIG. 2).

In these or other embodiments, face surface 214 (FIG. 2) can be located at front end 203 (FIG. 2), and rear surface 115 can be located at rear end 104. Further, rear surface 115 can be approximately opposite to face surface 214 (FIG. 2); rear center 118 can be approximately opposite face center 216 (FIG. 2); and rear perimeter 119 can be approximately opposite face perimeter 217 (FIG. 2). Generally, in many examples, face center 216 (FIG. 2) can refer to a geometric center of face surface 214 (FIG. 2). Accordingly, in these or other examples, face center 216 (FIG. 2) can refer to a location at face surface 214 (FIG. 2) that is approximately equidistant between toe end 105 and heel end 106 and further that is approximately equidistant between top end 101 and bottom end 102. In various examples, the face center can refer to the face center as defined at United States Golf Association: Procedure for Measuring the Flexibility of a Golf Clubhead, USGA-TPX 3004, Revision 1.0.0, p. 6, May 1, 2008 (retrieved May 12, 2014 from http://www.usga.org/equipment/testing/protocols/Test-Protocols-For-Equipment), which is incorporated herein by reference. Likewise, in some examples, rear center 118 can refer to a geometric center of rear surface 115.

By reference, x-axis 107 and y-axis 108 can extend approximately parallel to face surface 214 (FIG. 2), and z-axis 109 can extend approximately perpendicular to face surface 214 (FIG. 2). Meanwhile, each of x-axis 107, y-axis 108, and z-axis 109 can intersect rear center 118 such that rear center 118 comprises the origin of the Cartesian reference frame provided by x-axis 107, y-axis 108, and z-axis 109.

In various embodiments, scoring lines 223 (FIG. 2) can comprise one or more grooves, respectively, and can extend between toe end 105 and heel end 106. In these or other embodiments, scoring lines 223 (FIG. 2) can be approximately parallel to x-axis 107.

In many embodiments, reinforcement device 112 comprises one or more reinforcement elements 120 (e.g., reinforcement element 121). Reinforcement device 112 and/or reinforcement element(s) 120 are located at rear surface 115 and extend out from rear surface 115 toward rear end 104 and away from front end 203 (FIG. 2). In many embodiments, each reinforcement element of reinforcement element(s) 120 comprises an outer perimeter surface and a geometric center. In these or other embodiments, the geometric center(s) of one or more of reinforcement element(s) 120 (e.g., reinforcement element 121) can be located approximately at z-axis 109. For example, reinforcement element 121 can comprise outer perimeter surface 126 and geometric center 130.

Reinforcement device 112 and reinforcement element(s) 120 are configured to reinforce face element 111 while still permitting face element 111 to bend, such as, for example, when face surface 214 (FIG. 2) impacts a ball (e.g., a golf ball). As a result, face element 111 can be thinned to permit mass from face element 111 to be redistributed to other parts of club head 100 and to make face element 111 more flexible without buckling and failing under the resulting bending. Advantageously, because face element 111 can be thinner when implemented with reinforcement device 112 and reinforcement element(s) 120 than when implemented without reinforcement device 112 and reinforcement element(s) 120, the center of gravity, the moment of inertia, and the coefficient of restitution of club head 100 can be altered to improve the performance characteristics of club head 100. For example, implementing reinforcement device 112 and reinforcement element(s) 120 can increase a flight distance of a golf ball hit with face surface 214 (FIG. 2) by increasing a launch angle of the golf ball (e.g., by approximately 1-3 tenths of a degree), increase the ball speed of the golf ball (e.g., by approximately 0.1 miles per hour (mph) (0.161 kilometers per hour (kph) to approximately 3.0 mph (4.83 kph)), and/or decreasing a spin of the golf ball (e.g., by approximately 1-500 rotations per minute). In these examples, reinforcement device 112 and reinforcement element(s) 120 can have the effect of countering some of the gearing on the golf ball provided by face surface 214 (FIG. 2).

Testing of golf clubs comprising an embodiment of golf club head 100 was performed. Overall, when compared to an iron golf club with a standard reinforced strikeface and custom tuning port, the testing showed more forgiveness, as indicated by higher moments of inertia around the x-axis and/or the y-axis and a tighter statistical area of the impact of the golf ball on the face of the golf club head. In some testing, the moment of inertia about the x-axis increased by approximately 2%, the moment of inertia about the y-axis increased by approximately 4%, and/or the statistical area of the impact of the golf ball on the face of the golf club head was reduced by approximately 15-50 percent. Additionally, increased ball speed of the golf ball, higher launch angle of the golf ball, and/or decreased spin of the golf ball were found. As an example, in testing an embodiment of golf club 100 on a 5 iron golf club, it was found that the ball speed of the golf ball increased by approximately 1.5 mph (2.41 kph), the golf ball had an approximately 0.3 degree higher launch angle, and the spin of the golf ball decreased by approximately 250 revolutions per minute (rpm).

In another example, in testing an embodiment of golf club 100 on a 7 iron golf club, it was found that the ball speed of the golf ball increased by approximately 2.0 mph (3.22 kph), the golf ball had approximately no launch angle degree change, and the spin of the golf ball decreased by approximately 450 rpm. As an additional example, in testing an embodiment of golf club 100 on a wedge iron golf club, it was found that the ball speed of the golf ball had approximately no change in speed, the golf ball had an approximately 0.1 degree higher launch angle, and the spin of the golf ball decreased by approximately 200 rpm.

Figure 3:
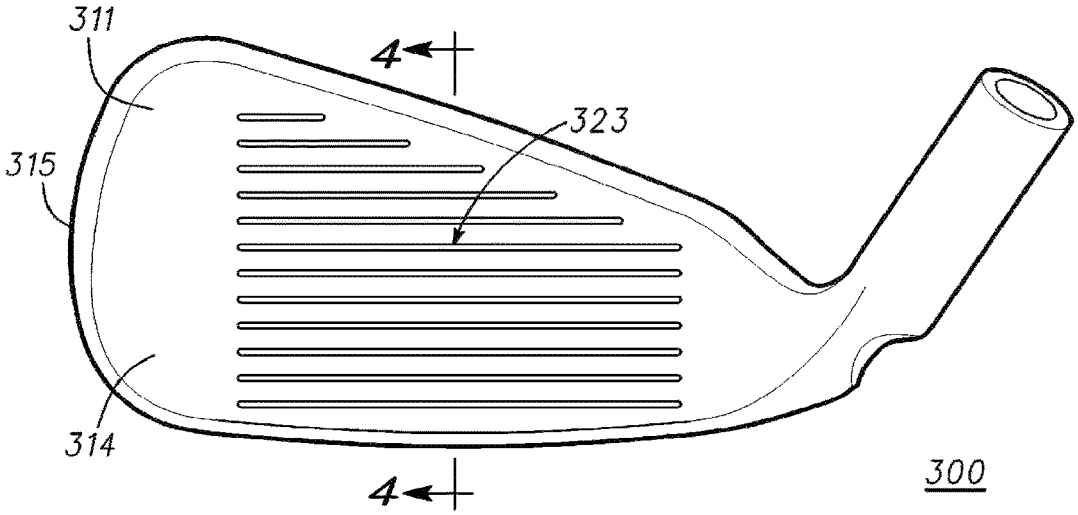
FIG. 3 illustrates a conventional club head, according to an embodiment.
Figure 4:
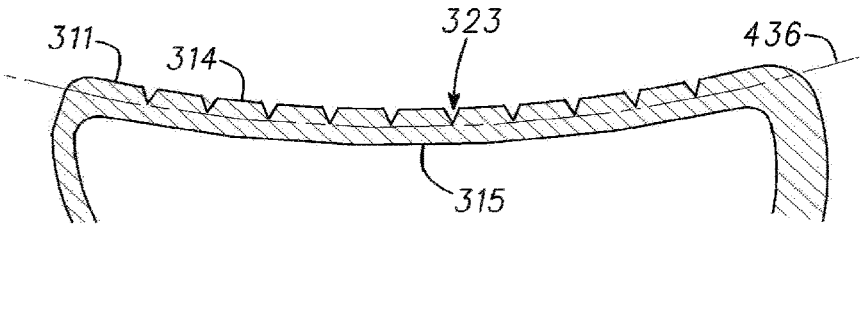
FIG. 4 illustrates a stress-strain analysis of a partial cross-sectional view of the conventional club head taken along section line 4-4 of FIG. 3 simulating a face surface of the conventional club head impacting a golf ball (not shown) where the resulting bending is multiplied three-fold, according to the embodiment of FIG. 3.

Notably, in many examples, when face element 111 comprises scoring line(s) 223 (FIG. 2) and face element 111 is thinned without implementing reinforcement device 112 and reinforcement element(s) 120, buckling and failure of face element 111 can occur at the bottom of scoring line(s) 223, particularly at scoring line(s) 223 (FIG. 2) proximal to face center 216 (FIG. 2), as illustrated at FIGS. 3 & 4 and described as follows with respect to FIGS. 3 & 4.

Club head 100 having reinforcement device 112 may also have a uniform transition thickness 550 (FIG. 5) extending from front end 203 to bottom end 102. Uniform transition thickness 550 absorbs stress directed to the region of club head 100 having reinforcement device 112 between front end 203 and bottom end 102. Uniform transition thickness 550 may range from approximately 0.20-0.80 inches. For example, uniform transition thickness 550 may be approximately 0.20, 0.25, 0.30, 0.35 0.40, 0.45, 0.50, 0.55, 0.60, 0.65, 0.70, 0.75, or 0.80 inches.

Specifically, turning ahead in the drawings, FIG. 3 illustrates conventional club head 300, according to an embodiment. Club head 300 can be similar to club head 100 (FIGS. 1 & 2), but unlike club head 100, is devoid of a reinforcement device and reinforcement elements at rear surface 315 of face element 311 of club head 300. Club head 300 comprises one or more scoring lines 323 at face surface 314 of club head 300. Rear surface 315 can be similar to rear surface 115 (FIG. 1); face element 311 can be similar or identical to face element 111 (FIG. 1); face surface 314 can be similar or identical to face surface 214 (FIG. 2); and/or scoring line(s) 323 can be similar or identical to scoring lines 223 (FIG. 2). Further, the absent reinforcement device can be similar to reinforcement device 112 (FIG. 1) and the absent reinforcement element(s) can be similar to reinforcement element(s) 120 (FIG. 1). Meanwhile, FIG. 4 illustrates a stress-strain analysis of a partial cross-sectional view of club head 300 taken along section line 4-4 of FIG. 3 simulating face surface 314 of club head 300 impacting a golf ball (not shown) where the resulting bending is multiplied three-fold, according to the embodiment of FIG. 3.

As demonstrated at FIG. 4, face element 311 behaves similarly to a simply supported beam and thus comprises neutral axis 436. The portion of face element 311 between face surface 314 and neutral axis 436 is in compression, and the portion of face element 311 between neutral axis 436 and rear surface 315 is in tension. Stress builds first at face surface 314 and rear surface 315 and moves inward toward neutral axis 436. However, unlike a simply supported beam, face element 311 also comprises scoring line(s) 323 at the portion of face element 311 that is in compression. When face element 311 bends too much, the mechanical yield of face element 311 in the bottom of scoring line(s) 323 can be reached. If not for scoring line(s) 323, face element 311 would ordinarily be expected to fail first in the portion of face element 311 that is under tension, but scoring line(s) 323 cause failure to occur first at the portion of face element 311 that is in compression. Namely, face element 311 fails at scoring line(s) 323 before the remainder of face element 311 has a chance to reach high enough stress levels to result in failure. Iron-type club heads can be more susceptible to failure at scoring line(s) 323 because iron-type club heads tend to be flat at face surface 314, unlike wood-type golf club head which tend to be convex at face surface 314. As a result, when wood-type golf club heads bend at face surface 314, face surface 314 can still be bowed somewhat outward. On the other hand, when iron-type golf club heads bend at face surface 314, face surface 314 can bend to a concave shape that increases the extent of the compression at the portion of face element 311 that is under compression.

Turning now back to FIGS. 1 & 2, implementing reinforcement device 112 and reinforcement element(s) 120 can reinforce a localized bending in scoring line(s) 223 (FIG. 2), particularly in those scoring line(s) of scoring line(s) 223 that are proximal to face center 216 (FIG. 2), while permitting increased overall bending in face element 111. Reinforcement device 112 and reinforcement element(s) 120 are able to provide these benefits by increasing the localized thickness of face element 111, making face element 111 stiffer and harder in those locations. In effect, reinforcement device 112 and reinforcement element(s) 120 are operable to pull a neutral axis of face element 111 away from face surface 214 (FIG. 2) and closer to rear surface 115.

Meanwhile, reinforcement device 112 and reinforcement element(s) 120 are further able to provide these benefits when implemented as a closed structure (e.g., one or more looped ribs) because such closed structures are able to resist deformation as a result of circumferential (i.e., hoop) stresses acting on reinforcement device 112 and reinforcement element(s) 120. For example, circumferential (i.e., hoop) stresses acting on reinforcement device 112 and reinforcement element(s) 120 can prevent opposing sides of reinforcement device 112 and reinforcement element(s) 120 from rotating away from each other, thereby reducing bending.

Further, reinforcement device 112 and reinforcement element(s) 120 absorb a substantial portion of the stress on club head 100 at impact, thereby preventing stress from being absorbed by other portions of club head 100 at impact, such as face element 111, face surface 214, and rear surface 115. Directing stress toward reinforcement device 112 and reinforcement element(s) 120 improves the durability of face element 111 and club head 100 compared to club head 300, devoid of a reinforcement device and reinforcement elements, or compared to a club head having reinforcement device 112 without or with fewer reinforcement element(s) 120.

In implementation, reinforcement element(s) 120 (e.g., reinforcement element 121) can be implemented in any suitable shape(s) (e.g., polygonal, elliptical, circular, etc.) and/or in any suitable arrangement(s) configured to perform the intended functionality of reinforcement device 112 and/or reinforcement element(s) 120 as described above. Further, when reinforcement element(s) 120 comprise multiple reinforcement elements, two or more reinforcement elements of reinforcement element(s) 120 can be similar to another, and/or two or more reinforcement elements of reinforcement element(s) 120 can be different from another.

In some embodiments, reinforcement element(s) 120 (e.g., reinforcement element 121) can be symmetric about x-axis 107 and/or y-axis 108. When reinforcement element(s) 120 (e.g., reinforcement element 121) are implemented with an oblong shape, in many embodiments, a largest dimension (e.g., major axis) of the reinforcement element(s) can be parallel and/or co-linear with one of x-axis 107 or y-axis 108. However, in other embodiments, the largest dimension (e.g., major axis) can be angled with respect to x-axis 107 and/or y-axis 108, as desired. Further, in many embodiments, reinforcement element(s) 120 (e.g., reinforcement element 121) can be centered at z-axis 109, but in some embodiments, one or more of reinforcement element(s) 120 (e.g., reinforcement element 121) can be biased off-center of z-axis 109, such as, for example, biased toward one or two of top end 101, bottom end 102, toe end 105, and heel end 106.

In many embodiments, each reinforcement element of reinforcement element(s) 120 (e.g., reinforcement element 121) can comprise one or more looped ribs 127 (e.g., looped rib 122). Specifically, reinforcement element 121 can comprise looped rib 122. In these or other embodiments, when looped rib(s) 127 comprise multiple looped ribs, looped rib(s) 127 can be concentric with each other about a point and/or axis (e.g., z-axis 109). In other embodiments, when looped rib(s) 127 comprise multiple looped ribs, two or more of looped rib(s) 127 can be nonconcentric. Further, in these or other embodiments, two or more of looped rib(s) 127 can overlap. Meanwhile, in these embodiments, looped rib 122 can comprise an elliptical looped rib, and in some of these embodiments, looped rib 122 can comprise a circular looped rib. As noted above, implementing reinforcement element(s) 120 as looped rib(s) 127 can be advantageous because of the circumferential (e.g., hoop) stress provided by the closed structure of looped rib(s) 127. In many embodiments, one or more of (or each of) looped rib(s) 127 is a continuous closed loop.

In these or other embodiments, each looped rib of looped rib(s) 127 comprises an outer perimeter surface and an inner perimeter surface. Meanwhile, in these embodiments, the outer perimeter surface of each reinforcement element (e.g., reinforcement element 121) comprises the outer perimeter surface of the looped rib corresponding to that reinforcement element (e.g., looped rib 122). For example, looped rib 122 can comprise outer perimeter surface 128 and inner perimeter surface 129. Further, inner perimeter surface 129 can be steep and substantially orthogonal at rib height 540 (FIG. 13) relative to the rear surface.

In some embodiments, one or more outer perimeter surface(s) of reinforcement element(s) 120 (e.g., outer perimeter surface 126 of reinforcement element 121) can be filleted with rear surface 115. In these or other embodiments, one or more inner perimeter surface(s) of looped rib(s) 127 (e.g., inner perimeter surface 129 of looped rib 122) can be filleted with rear surface 115. Filleting the outer perimeter surface(s) of reinforcement element(s) 120 (e.g., outer perimeter surface 126 of reinforcement element 121) with rear surface 115 can permit a smooth transition of reinforcement element(s) 120 (e.g., outer perimeter surface 126 of reinforcement element 121) into rear surface 115. Further, filleting the outer perimeter surface(s) of reinforcement element(s) 120 (e.g., outer perimeter surface 126 of reinforcement element 121) with rear surface 115 can direct stresses from impact into reinforcement element(s) 120 and away from the face surface 214. Meanwhile, outer perimeter surface(s) of reinforcement element(s) (e.g., outer perimeter surface 126 of reinforcement element 121) or inner perimeter surface(s) of looped rib(s) 127 (e.g., inner perimeter surface 129 of looped rib 122) can be filleted with rear surface 115 with a fillet 117 having a radius of greater than or equal to approximately 0.012 centimeters. For example, in some embodiments, the fillet 117 of the outer perimeter surface 126 with the rear surface 115 can range from approximately 0.012 centimeters to approximately 2.0 centimeters, from approximately 0.50 centimeters to approximately 3.0 centimeters, or from approximately 1.0 centimeters to approximately 4.0 centimeters. For further example, in some embodiments, the fillet 117 of the inner perimeter surface 129 with the rear surface 115 can range from approximately 0.012 centimeters to approximately 2.0 centimeters, from approximately 0.50 centimeters to approximately 3.0 centimeters, or from approximately 1.0 centimeters to approximately 4.0 centimeters.

In some embodiments, the outer perimeter surface(s) of reinforcement element(s) can be filleted directly with rear surface 115. In these embodiments, the face thickness decreases gradually along the fillet 117 from face thickness at rib height 540 to face thickness at rear surface 115.

Figure 15:
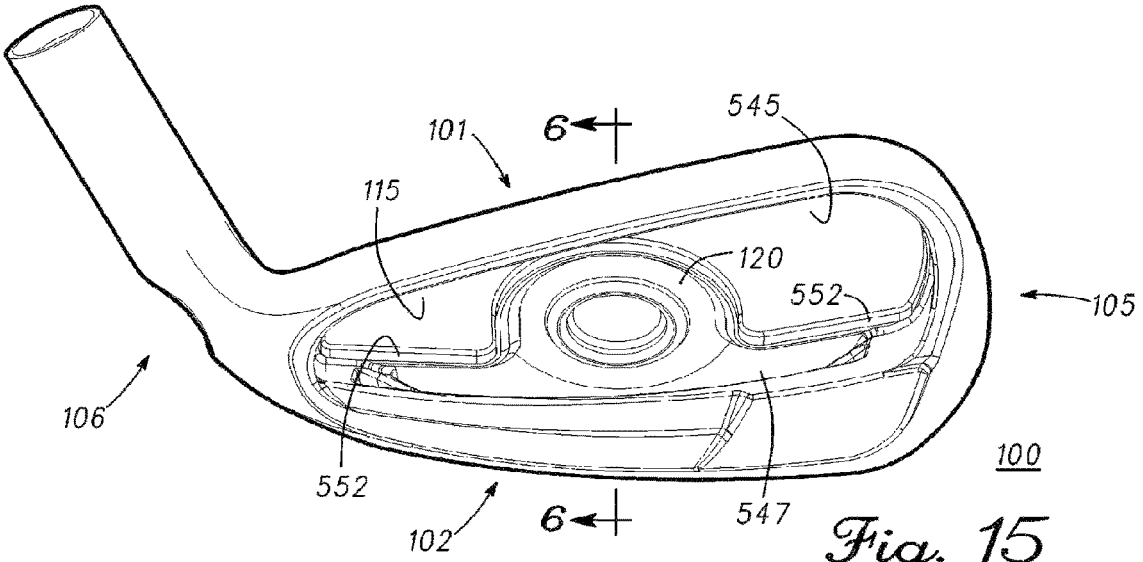
FIG. 15 illustrates a top, rear view of a club head, according to an embodiment.
Figure 16:
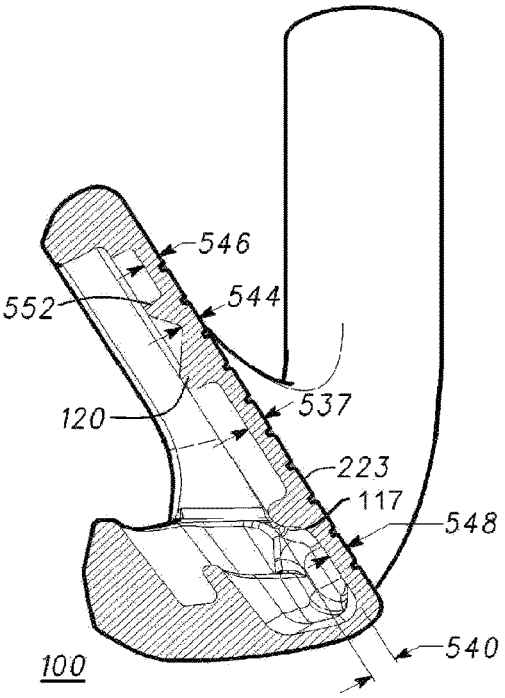
FIG. 16 illustrates a cross-sectional view of the club head taken along section line 6-6 of FIG. 15, according to the embodiment of FIG. 15.
Figure 17:
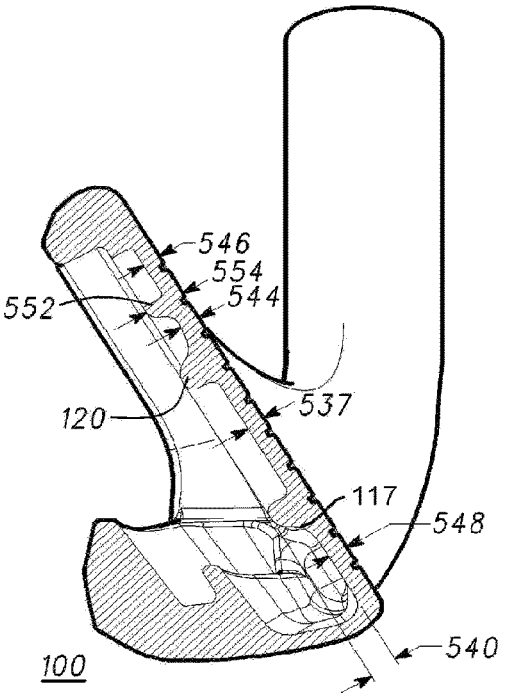
FIG. 17 illustrates a cross-sectional view of a club head according to another embodiment.

In some embodiments, club head 100 can further include a lip 552 on rear surface 115 of club head 100. Referring to FIGS. 15-17, in the illustrated embodiment, the lip 552 extends from the heel end 106 to the toe end 105 around the reinforcement element 120 of club head 100. In these or other embodiments, a fillet 117 on the outer perimeter surface of reinforcement element 120 can transition to the lip 552 such that the face thickness decreases gradually along the fillet 117 from the face thickness at rib height 540 to a minimum thickness 544, then increases gradually from the minimum thickness 544 to the face thickness at lip height 554. In these embodiments, the minimum thickness 544 between the reinforcement element 120 and the lip 552 can be greater than center thickness 537, the minimum thickness 544 between the reinforcement element 120 and the lip 552 can be approximately equal to center thickness 537, or the minimum thickness 544 between the reinforcement element 120 and the lip 552 can be less than center thickness 537. In the embodiment illustrated in FIGS. 15-16, the minimum thickness 544 between reinforcement element 120 and lip 552 is greater than center thickness 537. In the embodiment illustrated in FIG. 17, the minimum thickness 544 between reinforcement element 120 and lip 552 is approximately equal to center thickness 537.

In many embodiments, the minimum thickness 544 between the reinforcement element 120 and the lip 552 corresponds to faceplate bending and ball speed. As the minimum thickness 544 between the reinforcement element 120 and the lip 552 decreases, the outer perimeter surface of reinforcement element 120 can bend more during impact with a golf ball. Increased bending of the outer perimeter surface of reinforcement element 120 on impact allows increased faceplate deflection resulting in increased energy transfer to the golf ball and increased ball speed. For example, the golf club head 100 illustrated in FIG. 17 having a minimum thickness 544 between the reinforcement element 120 and the lip 552 approximately equal to center thickness 537 results in ball speeds up to 1 mile per hour (mph) faster than the club head 100 illustrated in FIGS. 15-16 having a minimum thickness 544 between the reinforcement element 120 and the lip 552 greater than center thickness 537.

Figure 8:
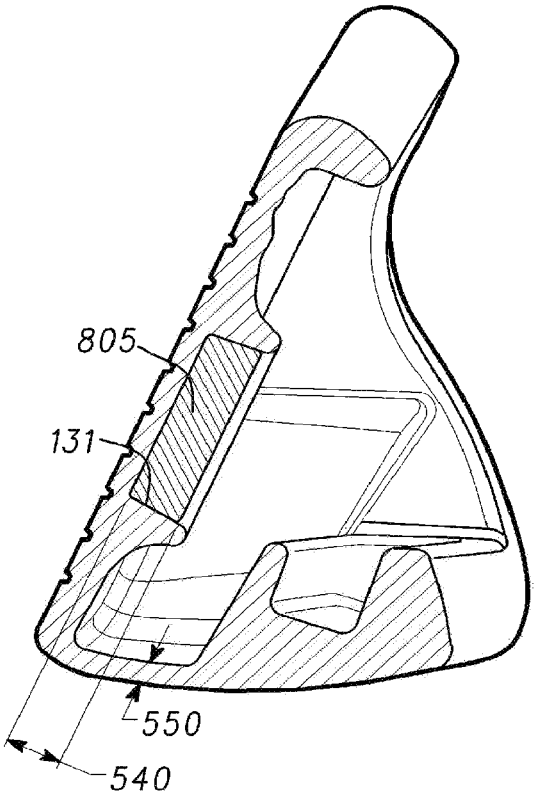
FIG. 8 illustrates a side view of the club head taken along section line 5-5 of FIG. 2, according to a different embodiment of FIG. 1.
Figure 9:
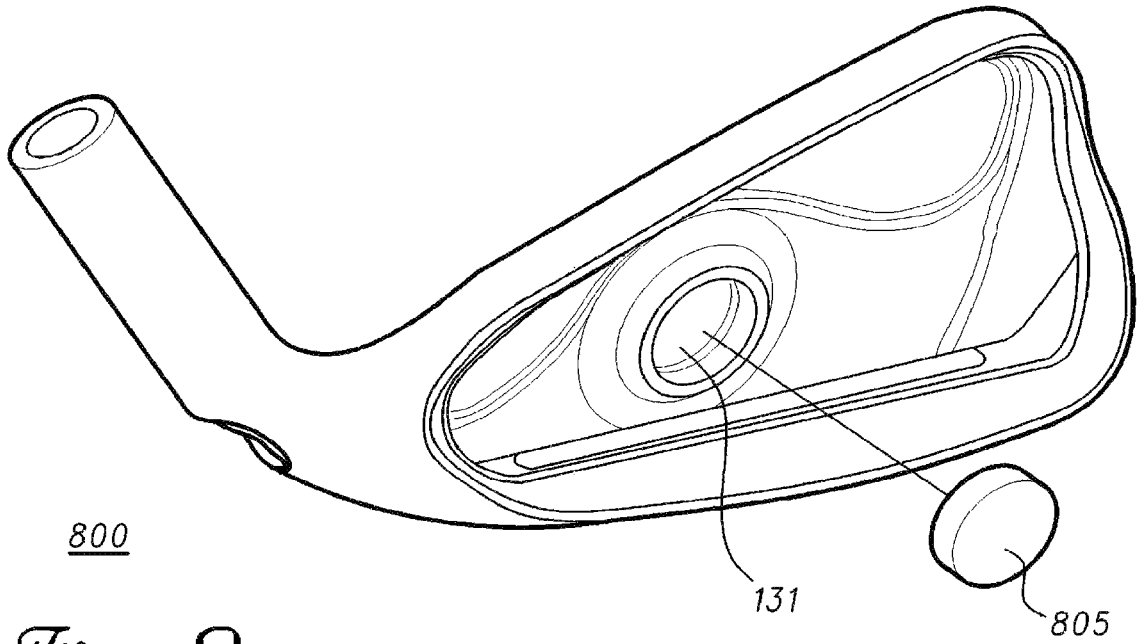
FIG. 9 illustrates a top, rear, heel side view of a club head, according to the embodiment of FIG. 8.

In some embodiments, when reinforcement element 121 comprises looped rib 122, looped rib 122 can comprise cavity 131. In other embodiments, when reinforcement element 121 comprises looped rib 122, looped rib 122 does not comprise cavity 131. In embodiments without cavity 131, the center thickness 537 (FIGS. 5 and 13) can be greater than in embodiments with cavity 131 and can be less than or equal to the face thickness at rib height 542 (FIGS. 5 and 13), which can be measured from face surface 214 (FIG. 2) to the distal end of looped rib 122 (e.g., the combined distance of center thickness 537 (FIG. 5) and rib height 542 (FIG. 5)). Cavity 131 is defined by inner perimeter surface 129 and rear surface 115. In some embodiments, cavity 131 can be a central cavity. In many embodiments, cavity 131 can be devoid of any contents, such as, for example, a weighted insert. In other embodiments, cavity 131 can contain an insert 805 as shown in FIGS. 8 and 9.

As discussed in some detail above, by implementing reinforcement device 112 and reinforcement element(s) 120, face surface 214 (FIG. 2) can be nearer to rear surface 115 (i.e., thinner) proximal to (e.g., at) face center 216 (FIG. 2) than proximal to (e.g., at) face perimeter 217 (FIG. 2). In some embodiments, a portion of face surface 214 (FIG. 2) that is proximal to face center 216 (FIG. 2) can refer to a portion of the surface area of face surface 214 bounding face center 216 (FIG. 2) and representing approximately one percent, two percent, three percent, five percent, ten percent, or twenty percent of a total surface area of face surface 214. In these or other embodiments, the portion of the surface area of face surface 214 (FIG. 2) can correspond to a portion of the surface area of rear face 115 covered by reinforcement element 121. Meanwhile, in some embodiments, a portion of face surface 214 (FIG. 2) that is proximal to face perimeter 217 (FIG. 2) can refer to a region of face surface 214 bounded by face perimeter 217 and an inset boundary located approximately 0.10 centimeters, 0.20 centimeters, 0.25 centimeters, 0.50 centimeters, 1.00 centimeters, or 2.00 centimeters from face perimeter 217 (FIG. 2).

Figure 5:
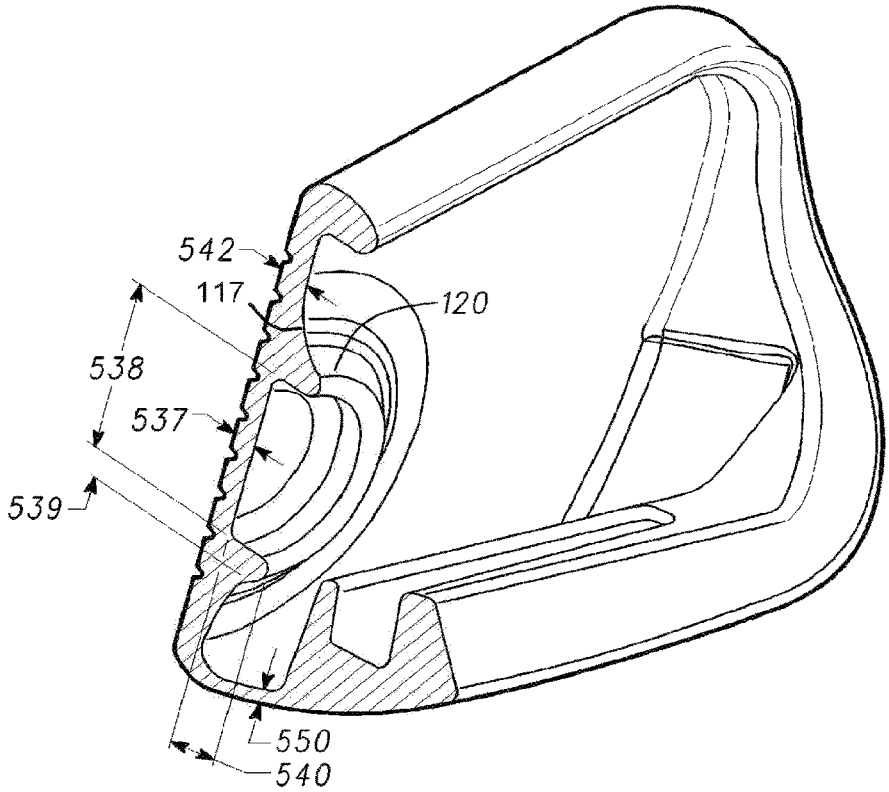
FIG. 5 illustrates a cross-sectional view of the club head taken along section line 5-5 of FIG. 2, according to the embodiment of FIG. 1.
Figure 13:
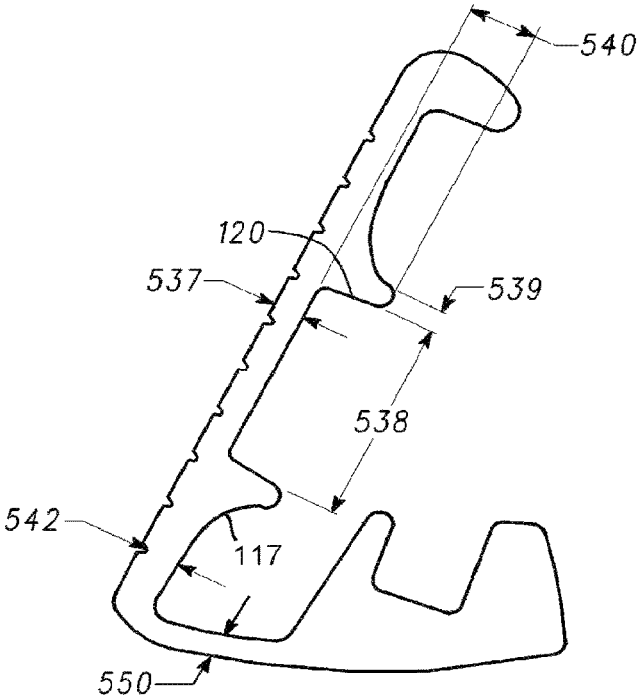
FIG. 13 illustrates a side view of the club head taken along section line 5-5 of FIG. 2, according to the embodiment of FIG. 1.

Turning ahead briefly in the drawings, FIGS. 5 and 13 illustrate a cross-sectional view of club head 100 taken along section line 5-5 of FIG. 2, according to the embodiment of FIG. 1. Club head 100 can comprise center thickness 537. Center thickness 537 can refer to a distance from face center 216 (FIG. 2) to rear center 118 (FIG. 1). In many embodiments, center thickness 537 can be approximately 0.150 cm to approximately 0.300 cm. In some embodiments, center thickness 537 can be less than 0.300 cm, less than 0.255 cm, less than 0.250 cm, less than 0.205 cm, less than 0.200 cm, or less than 0.155 cm. In some embodiments, the center of reinforcement element 120 can be at least partially filled in. For example, the center of reinforcement element 120 can be filled in with a damping material or a vibration attenuating feature (e.g., insert 805 (FIG. 8)) or other material. In many embodiments, center thickness 537 can be thinner than a face thickness at rib height 540. In other embodiments, center thickness 537 can be approximately equal to the face thickness at rib height 540. The face thickness at rib height 540 can be rib height 540 added to center thickness 537. In many embodiments, face thickness 542 outside of reinforcement element 120 can be thicker than center thickness 537, but thinner than the face thickness at rib height 540. In other embodiments, face thickness 542 can be the same as center thickness 537.

In some embodiments, face thickness at rib height 540 can be approximately 0.30 cm to approximately 0.70 cm. In some embodiments, face thickness at rib height 540 can be approximately 0.30 cm to approximately 0.50 cm. In some embodiments, face thickness at rib height 540 can be approximately 0.40 cm to approximately 0.60 cm. In some embodiments, face thickness at rib height 540 can be approximately 0.50 cm to approximately 0.70 cm. In some embodiments, face thickness at rib height 540 can be greater than 0.30 cm, greater than 0.40 cm, greater than 0.50, or greater than 0.60 cm.

In some embodiments, face thickness 542 outside of reinforcement element 120 can vary. FIGS. 15-16 illustrates a top portion 545 of faceplate outside reinforcement element 120 having a top thickness 546, and a bottom portion 547 of faceplate outside reinforcement element 120 having a bottom thickness 548. In some embodiments, top thickness 546 can be the same as bottom thickness 548 (FIGS. 5 and 13). In these embodiments, center thickness 537 can be thinner than top thickness 546 and bottom thickness 548, and top thickness 546 and bottom thickness 548 can be thinner than the face thickness at rib height 540. In some embodiments, top thickness 546 can be different than bottom thickness 548 (FIGS. 15-16). For example, in some embodiments, center thickness 537 can be thinner than top thickness 546, top thickness 546 can be thinner than bottom thickness 548, and bottom thickness 548 can be thinner than the face thickness at rib height 540. For further example, in some embodiments, top thickness 546 can be thinner than center thickness 537, center thickness 537 can be thinner than bottom thickness 548, and bottom thickness 548 can be thinner than the face thickness at rib height 540.

In many embodiments, face thickness 542 outside of reinforcement element 120 can be approximately 0.150 cm to approximately 0.300 cm. In some embodiments, face thickness 542 outside of reinforcement element 120 can be less than 0.300 cm, less than 0.255 cm, less than 0.250 cm, less than 0.205 cm, less than 0.200 cm, or less than 0.155 cm. In many embodiments, top thickness 546 can be approximately 0.150 cm to approximately 0.300 cm. In some embodiments, top thickness 546 can be less than 0.300 cm, less than 0.255 cm, less than 0.250 cm, less than 0.205 cm, less than 0.200 cm, or less than 0.155 cm. In many embodiments, bottom thickness 548 can be approximately 0.150 cm to approximately 0.300 cm. In some embodiments, bottom thickness 548 can be less than 0.300 cm, less than 0.255 cm, less than 0.250 cm, less than 0.205 cm, less than 0.200 cm, or less than 0.155 cm.

In many embodiments, face thickness 542 outside of reinforcement element 120 can be approximately 0.150 cm to approximately 0.300 cm, and center thickness 537 can be approximately 0.150 cm to approximately 0.300 cm, without requiring a backing material for support (e.g. without a filler materials such as an elastomer positioned behind the faceplate). For example, face thickness 542 outside of reinforcement element 120 can be approximately 0.150 cm to approximately 0.300 cm without having an elastomer or other flexible material positioned behind face thickness 542 outside of reinforcement element 120. For further example, center thickness 537 can be approximately 0.150 cm to approximately 0.300 cm without having an elastomer or other flexible material positioned behind face center thickness 537.

Typically, golf club head faceplates are designed to maximize ball speed (e.g. by reducing faceplate thickness) for particular swing speed requirements. Generally, faceplate thickness can be reduced with lower swing speed durability requirements (e.g. for a ladies golf club head compared to a men's golf club head), as the forces on impact with the club head decrease with swing speed. For example, a club head having lower swing speed durability requirements can have a lower center thickness 537, a lower face thickness at rib height 540, a lower top thickness 546, a lower bottom thickness 548, or any combination of the above described reductions in thickness compared to a club head with a higher swing speed durability requirement. In some embodiments, center thickness 537 can be approximately 0.150 cm to approximately 0.250 cm, top thickness 546 can be approximately 0.150 cm to approximately 0.250 cm, and bottom thickness 548 can be approximately 0.150 cm to approximately 0.250 cm, to allow the club head 100 to withstand swing speeds less than 100 miles per hour (mph) (160.9 kilometers per hour, kph), less than 90 mph (144.8 kph), less than 80 mph (128.7 kph), less than 70 mph (112.6 kph), or less than 60 mph (96.6 kph). In some embodiments, center thickness 537 can be approximately 0.200 cm to approximately 0.300 cm, top thickness 546 can be approximately 0.200 cm to approximately 0.300 cm, and bottom thickness 548 can be approximately 0.200 cm to approximately 0.300 cm, to allow the club head 100 to withstand swing speeds less than 130 mph (209.2 kph), less than 120 mph (193.1 kph), less than 110 mph (177.0 kph), less than 100 mph (160.9 kph), or less than 90 mph (144.8 kph).

In many embodiments, scoring lines 223 can have a depth of approximately 0.030 cm to approximately 0.060 cm. In some embodiments, scoring lines 223 can have a depth less than 0.060 cm, less than 0.055 cm, less than 0.050 cm, less than 0.045 cm, less than 0.040 cm, or less than 0.035 cm. For example, in the embodiment illustrated in FIGS. 15-16, the scoring lines 223 have a depth of approximately 0.046 cm. As described herein, measurements for center thickness 537, face thickness 542 outside of reinforcement element 120, top thickness 546, and bottom thickness 548 are determined in regions of the faceplate devoid of scoring lines. Accordingly, a faceplate thickness measured within a scoring line 223 will be lower (by the scoring line depth) than an associated faceplate thickness measured outside of, or adjacent to the scoring line 223 within the same region of the faceplate.

In some embodiments, a width of the rib can change throughout looped rib 122 (FIG. 1). In some embodiments, looped rib 122 (FIG. 1) and/or inner perimeter surface 129 (FIG. 1) can comprise largest rib span 538. Largest rib span 538 can refer to the largest distance from one side of inner perimeter surface 129 (FIG. 1) across to an opposing side of inner perimeter surface 129 (FIG. 1) measured parallel to rear surface 115 (FIG. 1). Accordingly, when looped rib 122 (FIG. 1) comprises an elliptical looped rib, largest rib span 538 can refer to a major axis of inner perimeter surface 129 (FIG. 1). Further, when looped rib 122 (FIG. 1) comprises a circular looped rib, largest rib span 538 can refer to a diameter of inner perimeter surface 129 (FIG. 1). Notably, in many embodiments, largest rib span 538 can be measured at a midpoint of inner perimeter surface 129 (FIG. 1).

Figure 6:
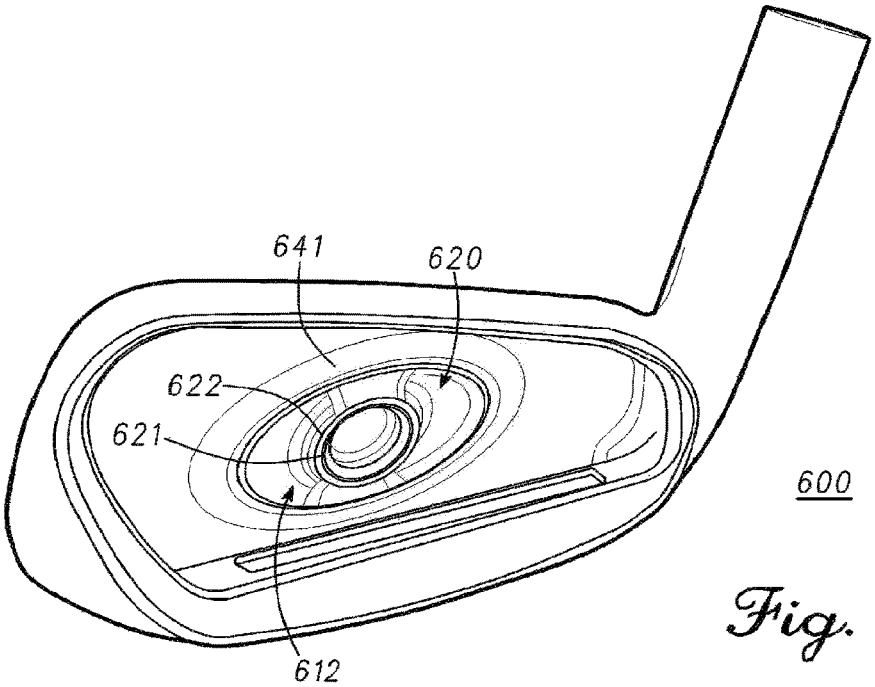
FIG. 6 illustrates a top, rear, toe side view of a club head, according to an embodiment.

In some embodiments, largest rib span 538 can be approximately 0.609 cm to approximately 1.88 cm. In some embodiments, largest rib span 538 can be approximately 1.0 cm. In some embodiments, when largest span 538 is too large (e.g., greater than approximately 1.88 centimeters), looped rib 122 (FIG. 1) can be insufficient to reinforce scoring line(s) 223 (FIG. 2) nearest to face center 216 (FIG. 2). Meanwhile, in these or other embodiments, when largest span 538 is too small (e.g., less than approximately 0.609 centimeters), looped rib 122 can be insufficient to reinforce scoring line(s) 223 (FIG. 2) nearest to face perimeter 217 (FIG. 2). Generally, these upper and lower limits on largest rib span 538 can be a function of a size of face element 111 (FIG. 1). In some embodiments, two or more ribs 621 and 641 can be present, for example as shown in FIG. 6. In this case, the larger rib span or inner or outer diameter of rib 641 (FIG. 6) can be greater than 1.88 centimeters, and the smaller rib span or inner or outer diameter of rib 621 (FIG. 6) can be less than 0.609 centimeters.

Further, looped rib 122 (FIG. 1) can comprise a rib thickness 539. Rib thickness 539 can refer to a distance between inner perimeter surface 129 (FIG. 1) of looped rib 122 (FIG. 1) and outer perimeter surface 128 (FIG. 1) of looped rib 122 (FIG. 1) measured parallel to rear surface 115 (FIG. 1). In some embodiments, the thickness of looped rib 122 (FIG. 1) can vary throughout looped rib 122 (FIG. 1), and rib thickness 539 can be a maximum rib thickness of looped rib 122 (FIG. 1). In many embodiments, rib thickness 539 can be approximately 0.050 cm to approximately 1.50 cm. In some embodiments, rib thickness 539 can be approximately 0.05 cm. In some embodiments, rib thickness 539 can be greater than or equal to approximately 0.25 centimeters. In some embodiments, rib thickness 539 can be approximately 0.50 centimeters. In some embodiments, rib thickness 539 can be approximately 0.75 centimeters. In some embodiments, rib thickness 539 can be approximately 1.00 centimeters. In some embodiments, rib thickness 539 can be approximately 1.25 centimeters. In some embodiments, rib thickness 539 can be approximately 1.50 centimeters. In various embodiments, when looped rib(s) 127 (FIG. 1) comprises multiple looped ribs, two or more looped ribs of looped rib(s) 127 (FIG. 1) can comprise the same rib thicknesses, and/or two or more looped ribs of looped rib(s) 127 (FIG. 1) can comprise different rib thicknesses. Notably, in many embodiments, rib span 539 can be measured at a midpoint of inner perimeter surface 129 (FIG. 1) and/or outer perimeter surface 128 (FIG. 1).

Further still, looped rib 122 (FIG. 1) can comprise rib height 540. Rib height 540 can refer to a distance perpendicular from rear surface 115 (FIG. 1) to a center location of looped rib 122 (FIG. 1) farthest from rear surface 115 (i.e., where outer perimeter surface 128 (FIG. 1) interfaces with inner perimeter surface 129 (FIG. 1). In these or other embodiments, rib height 540 can be greater than or equal to approximately 0.3048 centimeters. In some embodiments, rib height 540 can be approximately 0.1778 cm to approximately 0.3048 cm. In some embodiments, rib height 540 can be approximately 0.17 cm, 0.20 cm, 0.23 cm, 0.26 cm, 0.29 cm, or 0.30 cm. In many embodiments, rib height 540 can be less than or equal to approximately 0.512 cm. In some embodiments, the height of looped rib 122 (FIG. 1) can vary throughout looped rib 122, and rib height 540 can be a maximum rib height of looped rib 122 (FIG. 1). In various embodiments, when looped rib(s) 127 (FIG. 1) comprises multiple looped ribs, two or more looped ribs of looped rib(s) 127 (FIG. 1) can comprise the same rib heights, and/or two or more looped ribs of looped rib(s) 127 (FIG. 1) can comprise different rib heights.

In many embodiments, center thickness 537, largest rib span 538, rib thickness 539, and/or rib height 540 can depend on one or more of each other. For example, center thickness 537 can be a function of rib thickness 539 and rib height 540. That is, for an increase in rib thickness 539 and/or rib height 540, center thickness 537 can be decreased, and vice versa. Meanwhile, rib thickness 539 and rib height 540 can be dependent on each other. For example, increasing rib thickness 539 can permit rib height 540 to be decreased, and vice versa.

Returning now to FIGS. 1 & 2, in many embodiments, perimeter wall element 113 can comprise a first perimeter wall portion 124 and a second perimeter wall portion 125. Perimeter wall element 113 extends (i) at least partially (e.g., entirely) around rear perimeter 119 of rear surface 115, (ii) out from rear surface 115 toward rear end 104 and (iii) away from front end 203 (FIG. 2). Meanwhile, first perimeter wall portion 124 can extend along rear perimeter 119 of rear surface 115 at top end 101, and second perimeter wall portion 125 can extend along rear perimeter 119 of rear surface 115 at bottom end 102. In many embodiments, reinforcement device 112 and reinforcement element(s) 120 are separate and/or located away from perimeter wall element 113 at rear surface 115 so that reinforcement device 112 and reinforcement element(s) 120 float at rear surface 115. By floating reinforcement device 112 and reinforcement element(s) 120, face element 111 can be permitted to bend approximately symmetrically about face center 216 (FIG. 2).

In many embodiments, club head body 110 can comprise (i) a top surface 132 at least partially at first perimeter wall portion 124 and/or top end 101, and/or (ii) a sole surface 133 at least partially at second perimeter wall portion 125 and/or bottom end 102. Accordingly, in some embodiments, first perimeter wall portion 124 can comprise at least part of top surface 132; and/or second perimeter wall portion 125 can comprise at least part of sole surface 133. Further, top surface 132 can interface with face surface 214 (FIG. 2) at top end 101; and/or sole surface 133 can interface with face surface 214 (FIG. 2) at bottom end 102.

In some embodiments, at least part of second perimeter wall portion 125 can be approximately equal thickness with or thinner than face element 111 at face perimeter 217 (FIG. 2) and/or proximal to face perimeter 217. For example, second perimeter wall portion 125 can be equal thickness with or thinner than face element 111 at face perimeter 217 (FIG. 2) and/or proximal to face perimeter 217 at a portion of second perimeter wall portion 125 that is proximal to face perimeter 217 (i.e., where second perimeter wall portion 125 interfaces with face element 111). Implementing this portion of second perimeter wall portion 125 to be equal thickness with or thinner than face element 111 at face perimeter 217 (FIG. 2) and/or proximal to face perimeter 217 can prevent stress risers from forming at second perimeter wall portion 125 when face surface 214 (FIG. 2) impacts a golf ball.

Rear surface 115 comprises a first rear surface portion and a second rear surface portion. The first rear surface portion can refer to the part of rear surface 115 covered by perimeter wall element 113, and the second rear surface portion can refer to the remaining part of rear surface 115. In many embodiments, reinforcement element 121 (e.g., looped rib 122) can cover greater than or equal to approximately 25 percent of a surface area of the second rear surface portion of rear surface 115 and/or less than or equal to approximately 40 percent of a surface area of the second rear surface portion of rear surface 115. In other embodiments, reinforcement element 121 (e.g., looped rib 122) can cover greater than or equal to approximately 30 percent of a surface area of the second rear surface portion of rear surface 115. In some embodiments, reinforcement element 121 (e.g., looped rib 122) can cover approximately 25 percent, 28 percent, 31 percent, 34 percent, 37 percent or 40 percent of a surface area of the second rear surface portion of rear surface 115.

Further, club head body 110 can comprise hosel 134 or any other suitable mechanism (e.g., a bore) for receiving and coupling a shaft to club head 100 and/or club head body 110. The other suitable mechanism can be similar to hosel 134 in one or more respects.

Meanwhile, generally speaking, hosel 134 can be located at or proximate to heel end 106. Although a shaft is not illustrated at the drawings, hosel 134 can be configured to receive a shaft (i.e., via an opening of hosel 134), such as, for example, a golf club shaft. Accordingly, hosel 134 can receive the shaft and permit the shaft to be coupled (e.g., permanently or removably) to club head 100 and/or club head body 110 when hosel 134 receives the shaft.

Further, in some embodiments, second perimeter wall portion 125 can comprise weight cavity 135. In these embodiments, weight cavity 135 can be configured to receive a removable or permanent weighted insert. The weighted insert can be positioned in weight cavity 135 such that the weighted insert is positioned closer to the bottom end 102 of club head 100 than the center of gravity of club head 100. In other words, the weighted insert can be positioned in weight cavity 135 such that the center of gravity of club head 100 is positioned closer to the top end 101 of club head 100 than the weighted insert. The weighted insert can be configured to alter a center of gravity of club head 100.

Figure 7:
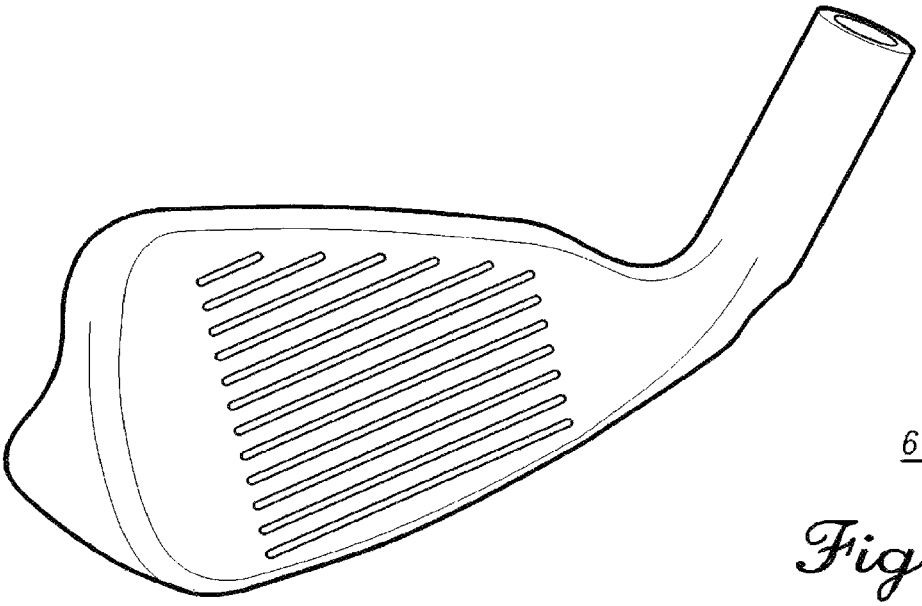
FIG. 7 illustrates a top, front, toe side view of the club head, according to the embodiment of FIG. 6.

Turning ahead in the drawings, FIG. 6 illustrates a top, rear, toe side view of a club head 600, according to an embodiment. Meanwhile, FIG. 7 illustrates a top, front, toe side view of club head 600, according to the embodiment of FIG. 6.

Club head 600 can be similar or identical to club head 100 (FIG. 1). Accordingly, club head 600 can comprise reinforcement device 612, and reinforcement device 612 can comprise reinforcement element(s) 620. Reinforcement device 612 can be similar or identical to reinforcement device 112 (FIG. 1); and reinforcement element(s) 620 can be similar or identical to reinforcement element(s) 120 (FIG. 1).

Reinforcement element(s) 620 can comprise first reinforcement element 621 and second reinforcement element 641. First reinforcement element 621 and/or second reinforcement element 641 each can be similar to first reinforcement element 121 (FIG. 1). Accordingly, first reinforcement element 621 can comprise first looped rib 622, and second reinforcement element 641 can comprise second looped rib 642. First looped rib 622 and/or second looped rib 642 each can be similar to looped rib 122 (FIG. 1).

In these embodiments, first reinforcement element 621 and/or first looped rib 622 can comprise a circular looped rib, and second reinforcement element 622 and/or second looped rib 642 can comprise an elliptical looped rib. Second reinforcement element 622 and/or second looped rib 642 can enclose first reinforcement element 621 and/or first looped rib 622. In many embodiments, a major axis of the elliptical looped rib can be approximately parallel with an x-axis of club head 600. The x-axis can be similar or identical to x-axis 107 (FIG. 1). In the same or different embodiments, the minor axis of the elliptical looped rib can be non-parallel with a y-axis of club head 600. The y-axis can be similar or identical to y-axis 108 (FIG. 1).

Club head 600 having reinforcement device 612 may also have uniform transition thickness 550 (not shown) extending from front end 203 to bottom end 102. Uniform transition thickness 550 absorbs stress directed to the region of club head 600 having reinforcement device 612 between front end 203 and bottom end 102. Uniform transition thickness 550 may range from approximately 0.20-0.80 inches. For example, uniform transition thickness 550 may be approximately 0.20, 0.25, 0.30, 0.35 0.40, 0.45, 0.50, 0.55, 0.60, 0.65, 0.70, 0.75, or 0.80 inches.

In another embodiment, FIG. 8 illustrates a side view of club head 800 taken along section line 5-5 of FIG. 2, according to a different embodiment of FIG. 1. Club head 800 shown in FIG. 8 illustrates an insert 805 within cavity 131. FIG. 9 illustrates a top, rear, heel side view of club head 800, according to the embodiment of FIG. 8. In some embodiments, insert 805 can be a vibration attenuating feature. Insert 805 can be a non-metallic material, an elastomeric material such as polyurethane, or another material such as foam. Insert 805 can be used to adjust the sound and feel of club head 800. By absorbing or damping vibration, insert 805 improves the feel of club head 800. In addition, insert 805 absorbs the sound of a golf ball striking the face, making golf club 800 head feel less hollow and more solid. In further embodiments, a badge (not shown) can at least partially cover cavity 131. The badge can be separate from insert 805 or can be integral with insert 805. In other embodiments, the badge can be integral with the reinforcement element, such as reinforcement element 120 (FIG. 1).

In some cases, the weight of insert 805 can be less than about 3 g so as to not significantly affect the swing weight or the center of gravity of club head 800. In other embodiments, insert 805 weight can be more than about 3 g, such as about 5 g to about 10 g, and can contribute substantially to the swing weight and/or the center of gravity of club head 800. In some embodiments, insert 805 can be adhered to cavity 131 using an epoxy adhesive, a viscoelastic foam tape, the vibration attenuating feature, or a high strength tape such as 3M™ VHB™ tape. In other embodiments, insert 805 can be poured and bonded directly into cavity 131. The badge can be bonded with similar adhesives. In some embodiments, insert 805 or the badge can be flush with looped rib 122 (FIG. 1) at the top of rib height 540, or they can be below rib height 540 when fully assembled.

In some embodiments, at least one vibration attenuating feature (e.g., insert 805 (FIG. 8) can be disposed on rear surface 115 (FIG. 1) of the golf club head, such as golf club head 800. The vibration attenuating feature can produce a more desirable sound from the golf club head 800 upon impact. The thin face element 111 (FIG. 1) of golf club head 800 can cause undesirable sounds when striking a golf ball. The vibration attenuating feature can reduce the vibrations leading to a more desirable sound on impact by thin face element 111 (FIG. 1). By providing a more desirable noise, the vibration attenuating component can increase a user's confidence during use. The vibration attenuating feature can also reduce the vibrational shock felt by the user of the golf club upon striking the golf ball. Furthermore, the vibration attenuating feature may reduce vibrational fatigue to decrease wear on golf club 800 and various features such as, but not limited to, cavity 131 or weight cavity 135 (FIG. 1). The reduced vibrational fatigue can further lower the risk of loosening or displacement of parts such as, but not limited to, insert 805 of cavity 131 or an insert in weight cavity 135 (FIG. 1). The reduced vibrational fatigue may extend the performance life of golf club head 800.

Figure 12:
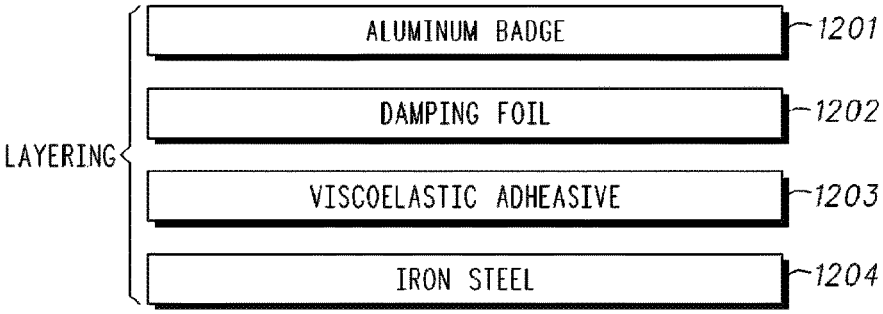
FIG. 12 illustrates a diagram for an embodiment of the layers of a vibration attenuating feature.

As seen in FIG. 12, in further embodiments, the vibration attenuating feature may comprise at least one layer of a viscoelastic damping material. The damping material may comprise a pressure sensitive viscoelastic acrylic polymer and aluminum foil forming a damping foil 1202 such as 3M™ Damping Foil Tape 2552. The damping foil 1202 may comprise an adhesive layer. In one embodiment the vibration attenuating feature may comprise at least one viscoelastic adhesive layer 1203 which may comprise a composition of varying layers of at least one layer of epoxy adhesive, a viscoelastic foam tape, and/or a high strength tape such as 3M™ VHB™ tape. In some embodiments, the vibration attenuating feature may comprise various layer combinations of at least one of viscoelastic adhesive 1203, damping foil 1202, and/or a badge 1201.

Returning to FIG. 8, in some embodiments, the vibration attenuating feature can be disposed on the rear surface 115 (FIG. 1) of the golf club head, such as golf club head 800, which comprises a rear surface material such as iron steel 1204. In another embodiment, the vibration attenuating feature can be disposed in cavity 131, or on or under insert 805 of the golf club head 800. The vibration attenuating feature can be located in various locations of the rear surface 115 (FIG. 1) of the golf club head 800. Generally, the vibration attenuating feature is at least partially located under the profile of the badge on the rear surface 115 (FIG. 1). In some embodiments, the vibration attenuating feature is disposed under the entirety of the badge profile. In other embodiments, the vibration attenuating feature is at least partially disposed under only particular regions of the badge profile such as the aluminum or elastomer regions. The vibration attenuating feature can be disposed under only at least part of the perimeter region of the badge profile. In some embodiments the vibration attenuating feature can be disposed at least partially in cavity 131 of the golf club head 800. The vibration attenuating feature may be disposed at least partially on or under insert 805 within cavity 131. In many embodiments the disposition of the vibration attenuating feature on golf club head 800 will comprise varying combinations the foil being disposed at least partially under the badge, at least partially over insert 805, at least partially in weight cavity 135 (FIG. 1), and/ or at least partially in cavity 131. In some embodiments, the vibration attenuating feature will be disposed such that it covers at least 10 percent of the surface area of rear surface 115 (FIG. 1). In other embodiments, the vibration attenuating feature may cover at least 15, 20, 25, 30, 35, 40, 45, 50, 55, 60, 65, 70, 75, 80, 85, 90, 95, or 100 percent of the surface area of rear surface 115.

Club head 800 having insert 805 may also have uniform transition thickness 550 (FIG. 8) extending from front end 203 to bottom end 102. Uniform transition thickness 550 absorbs stress directed to the region of club head 800 having insert 805 between front end 203 and bottom end 102. Uniform transition thickness 550 may range from approximately 0.20-0.80 inches. For example, uniform transition thickness 550 may be approximately 0.20, 0.25, 0.30, 0.35 0.40, 0.45, 0.50, 0.55, 0.60, 0.65, 0.70, 0.75, or 0.80 inches.

Figure 18A:
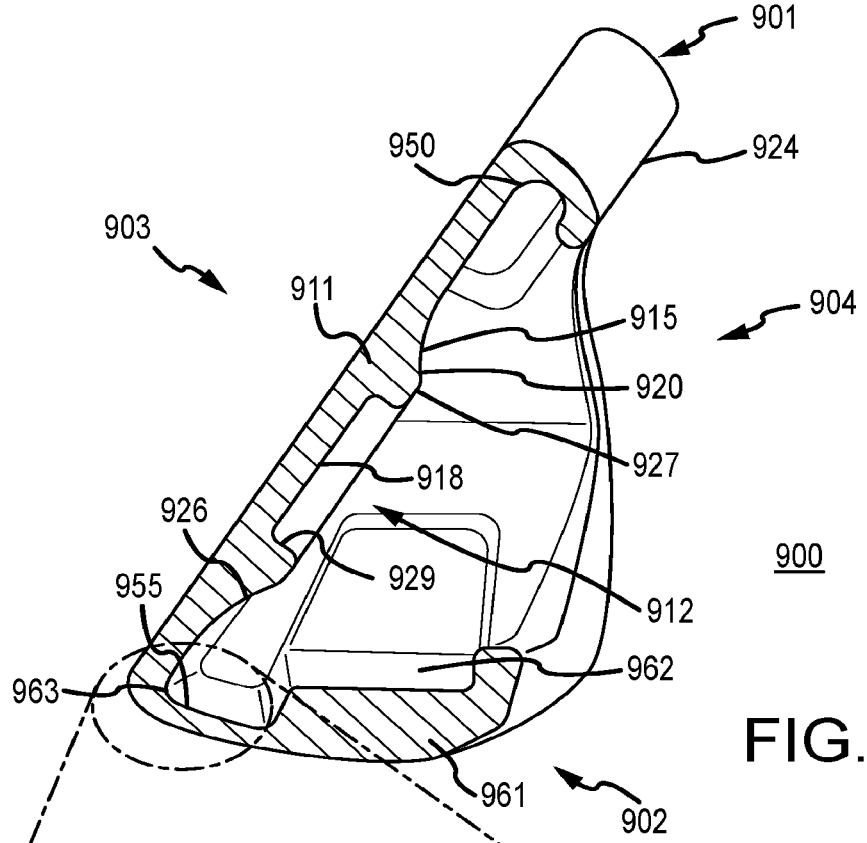
FIG. 18A illustrates a cross-sectional view of a club head according to another embodiment.

In another embodiment, as illustrated in FIG. 18A, is a cross-sectional side view of club head 900. Club head 900 can be similar to club head 100, having a club head body 910 which comprises a top end 901, a bottom end 902, a toe end 905, a heel end 906, a front end 903, a rear end 904, and a face element 911. The face element 911 comprises a face surface 914 (i.e, a strikeface, or striking plate) located on the front end 903, and a rear surface 915 located on the rear end 904, wherein the rear surface 915 comprises a rear center 918.

The top end 901 of the club head body 910 comprises a top rail 924 extending in an arcuate fashion away from the front end 903, toward the rear end 904 and the bottom end 902. The top rail 924 extends along the top end 901, from the toe end 905 to the heel end 906. A recess within the curvature located between the rear surface 915 of the face element 911, and the top rail 924 defines an undercut 950. In many embodiments, the undercut 950 extends along the top rail 924 from the toe end 905 to the heel end 906. In other embodiments, the undercut 950 can extend along the top rail 924, and into a portion of the toe end 905, a portion of the heel end 906, or a combination of a portion of the toe end 905, and a portion of the heel end 906. The undercut 950 can also be applied to club heads 300, 600 and 800.

The face element 911 further comprises a reinforcement device 912 similar to the reinforcement device 112, and 612. The reinforcement device 912 is located on the rear surface 915 generally at the rear center 918. The reinforcement device 912 extends from the rear surface 915 away from the front end 903. The reinforcement device 912 comprises one or more reinforcement elements 920. In many embodiments, each reinforcement element of the reinforcement elements 920 comprises an outer perimeter surface 926, an inner perimeter surface 929, and a geometric center. The reinforcement elements 920 can further comprise looped ribs 927. In these or other embodiments, the geometric center(s) of one or more of reinforcement elements 920 can be at the rear center 918 of the rear surface 915.

In some embodiments, the looped ribs 927 can comprise multiple looped ribs, wherein each looped rib 927 can be concentric with each other. In other embodiments, when looped ribs 927 comprise multiple looped ribs, two or more of looped ribs 927 can be nonconcentric. Further, in these or other embodiments, two or more of looped rib 927 can overlap. Meanwhile, in some embodiments, looped ribs 927 can comprise an elliptical looped rib, and in other embodiments, looped ribs 927 can comprise a circular looped rib.

In implementation, reinforcement element(s) 920 and looped ribs 927 can be implemented in any suitable shape(s) (e.g., polygonal, elliptical, circular, etc.) and/or in any suitable arrangement(s) configured to perform the intended functionality of reinforcement device 912 and/or reinforcement element(s) 920 as described above. Further, when reinforcement element(s) 920 comprise multiple reinforcement elements, two or more reinforcement elements of reinforcement element(s) 920 can be similar to another, and/or two or more reinforcement elements of reinforcement element(s) 1520 can be different from another.

In some embodiments, one or more outer perimeter surfaces 926 of reinforcement elements 920 can be filleted with rear surface 915. In these or other embodiments, one or more inner perimeter surfaces 929 of looped ribs 927 can be filleted with rear surface 915. Filleting the outer perimeter surface 926 of reinforcement elements 920 with rear surface 915 can permit a smooth transition of reinforcement elements 920 into rear surface 915. Further, filleting the outer perimeter surface 926 of reinforcement elements 920 with rear surface 915 can direct stresses from impact into reinforcement elements 920 and away from the face surface 914. Meanwhile, outer perimeter surface 926 of reinforcement elements 920 or inner perimeter surface 929 of looped ribs 927 can be filleted with rear surface 915 with a fillet 923 having a radius of greater than or equal to approximately 0.012 centimeters. For example, in some embodiments, the fillet 923 of the outer perimeter surface 926 with the rear surface 915 can range from approximately 0.012 centimeters to approximately 2.0 centimeters, from approximately 0.50 centimeters to approximately 3.0 centimeters, or from approximately 1.0 centimeters to approximately 4.0 centimeters. For further example, in some embodiments, the fillet 923 of the inner perimeter surface 929 with the rear surface 915 can range from approximately 0.012 centimeters to approximately 2.0 centimeters, from approximately 0.50 centimeters to approximately 3.0 centimeters, or from approximately 1.0 centimeters to approximately 4.0 centimeters.

In some embodiments, the outer perimeter surface 926 of reinforcement elements 920 can be filleted directly with rear surface 915. In these embodiments, the face thickness decreases gradually along the fillet 923 from face thickness at an apex of the reinforcement element 920 to face thickness at rear surface 915.

In some embodiments, club head 900 can further include a lip (not pictured) on rear surface 915 of club head 900 similar to the lip 552 as described above and FIGS. 9-17. The lip of club head 900 can extend from the heel end 906 to the toe end 905 around the reinforcement element 920 of club head 900. In these or other embodiments, a fillet 923 on the outer perimeter surface 926 of the reinforcement elements 920 can transition to the lip such that the face thickness decreases gradually along the fillet 923 from the apex of the reinforcement element 920 to a minimum thickness between the lip and the reinforcement element 920, then increases gradually from the minimum thickness to the an apex of the lip. In these embodiments, the minimum thickness between the reinforcement element 920 and the lip can be greater than the thickness at the face center 916, the minimum thickness between the reinforcement element 920 and the lip can be approximately equal to the thickness at the face center 916, or the minimum thickness between the reinforcement element 920 and the lip can be less than the thickness at the face center 916.

Figure 18B:
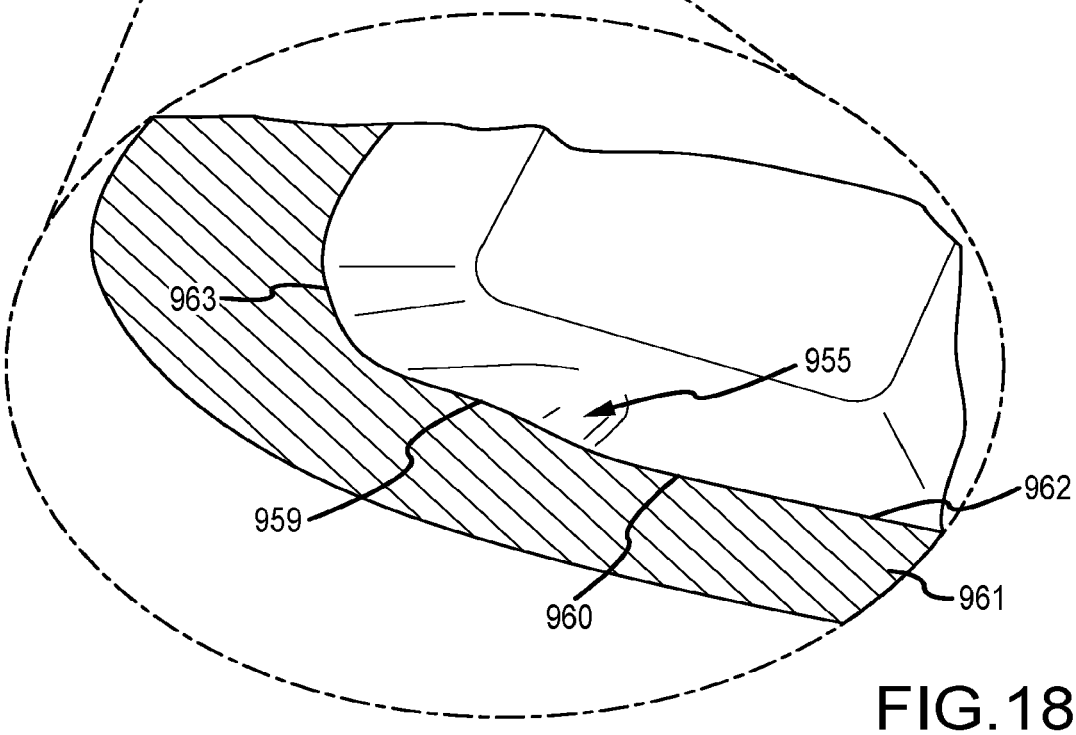
FIG. 18B illustrates a close-up view of the cross-sectional view of the club head according to the embodiment of FIG. 18A.

The bottom end 902 of the club head body 910 may further comprise a sole 961, wherein the sole 961 comprises an inner sole surface 962. Further, the sole 961 can be also be a feature in club heads 300, 600 and 800. As illustrated in FIGS. 18A and 18B, there is an internal radius transition 963 from the rear surface 915 of the of the face element 911 to the inner sole surface 962. The radius transition 963 can comprise a smooth transition or a cascading sole 955 proximate the rear surface 915 of the face element 911. As illustrated in FIG. 18B, the cascading sole 955 can comprise a first tier 959, and a second tier 960, wherein the first tier 959 is proximal the front end 903 and the second tier 960 is proximal the rear end 904 with the first tier 959 transitioning to the second tier 960. Further, the first tier 959 comprises a thickness than a thickness of the second tier 960 . Further details of the cascading sole 955 are disclosed in U.S. application Ser. No. 14/920,280 for Golf Club Heads with Energy Storage Characteristics.

The undercut 950 increases the structural integrity of the face element 911 of club head 900. More specifically, the location of the undercut allows for a larger distribution area of the stresses the face element 911 experiences at the top end 901 during impact with a ball, wherein the stress moves along the top rail 924. The distribution of stresses in the top rail of the top end 901 can prevent permanent deformation of the face element 911. Maintaining the structural integrity of the face element 911 allow for the club head body 910 to produce consistent optimal performance characteristics and feel, wherein the performance (i.e., ball speed, ball trajectory) do not degrade over time and after multiple uses.

Further, the undercut 950 located directly rearward of the front end 903 on the top end 901 allows the face element 911 to have a greater deflection during impact. The deflection of the face element 911 affects the coefficient of restitution (COR) of the club head 900. The COR measures the elasticity of an object in collision and is the ratio of the object's final relative speed to the objects' initial relative speed. A higher COR results in increased ball speed and distance, and a lower COR results in decreased ball speed and distance. Therefore, the undercut 950 of the club head 900 affects the distance and speed of the ball after impact. As the undercut 950 increases the deflection of the face element 911, the distance and speed of the ball also increases.

Further still, the undercut 950 allows for removal of mass from the top end 901 of the club head.

The removed mass can then be redistributed to other locations on the club head (e.g., the bottom end 902, the toe end 905, the heel end 906, or any combination thereof). The redistribution of mass provides the club head with higher performance characteristics such as increased moment of inertia (MOI) and ideal center of gravity (CG) placement. Increased MOI and ideal CG placement can lead to increased ball speeds as well as prevent rotation of the club head 900 from toe end 905 to heel end 906 during a swing. Preventing the rotation of the club head 900 from toe end 905 to heel end 906 allows for better contact with the ball and a more ideal trajectory of the ball (i.e. straight).

As described previously, reinforcement device 912 and reinforcement element(s) 920 are configured to reinforce face element 911 while still permitting face element 911 to bend, such as, for example, when face surface 914 impacts a golf ball. As a result, face element 911 can be thinned to permit mass from face element 911 to be redistributed to other parts of club head 900 and to make face element 911 more flexible without buckling and failing under the resulting bending. Advantageously, because face element 911 can be thinner when implemented with reinforcement device 912 and reinforcement element(s) 920, the center of gravity, the moment of inertia, and the coefficient of restitution of club head 900 can be altered to improve the performance characteristics of club head 900. For example, implementing reinforcement device 912 and reinforcement element(s) 920 can increase a flight distance of a golf ball hit with face surface 914 by increasing launch angle, increasing the ball speed, and/or decreasing spin of the golf ball. In these examples, reinforcement device 912 and reinforcement element(s) 920 can have the effect of countering some of the gearing on the golf ball provided by face surface 914.

The reinforcement device 912 and reinforcement element(s) 920 are further able to provide stress reducing benefits when implemented as a closed structure (i.e., looped ribs 927) because such closed structures are able to resist deformation as a result of circumferential (i.e., hoop) stresses acting on reinforcement device 912 and reinforcement element(s) 920. For example, circumferential (i.e., hoop) stresses acting on reinforcement device 912 and reinforcement element(s) 920 can prevent opposing sides of reinforcement device 912 and reinforcement element(s) 920 from rotating away from each other, thereby reducing bending.

The cascading sole 955 allows some of the stress experienced by the face element 911 near the sole 961, to distribute to the first tier 959 and the second tier 960. The distribution of stress to the first tier 959 and the second tier 960 of the cascading sole 955 prevent the stress from collecting primarily at the thinnest section of the face element 911 near the sole 961. The distribution of stresses in the first tier 959 and the second tier 960 in the sole 961 can prevent permanent deformation, and maintain the structural integrity of the face element 911. Therefore, the face element 911 can produce more consistent performance and feel after a plurality of impacts with the ball.

Figure 19:
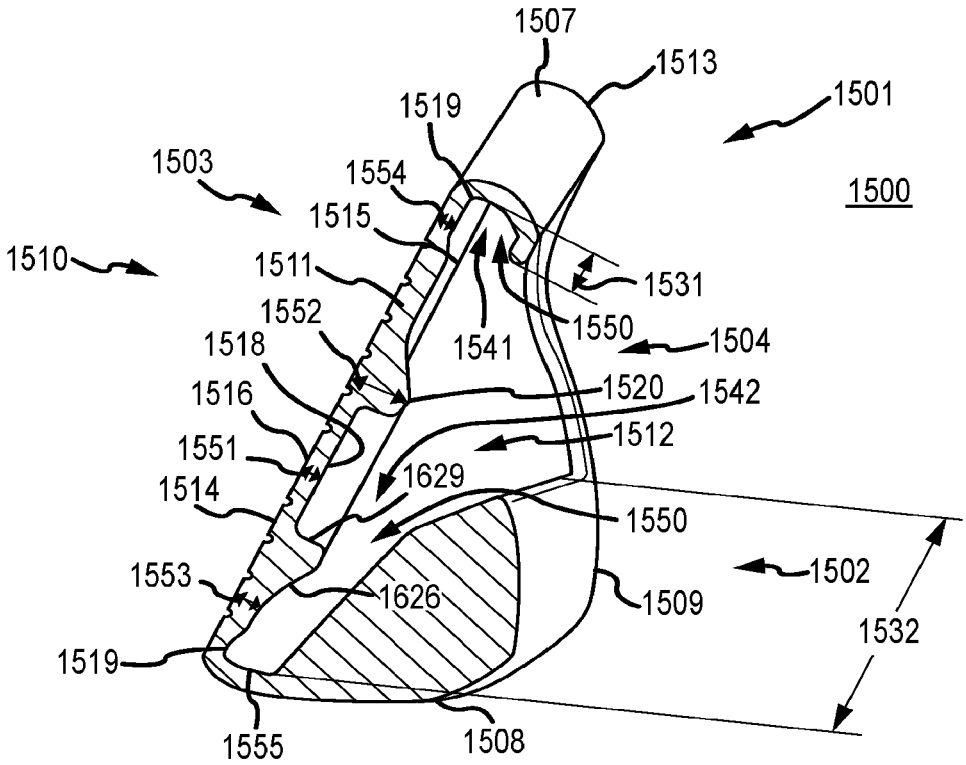
FIG. 19 illustrates a cross-sectional view of a club head according to another embodiment.
Figure 20:
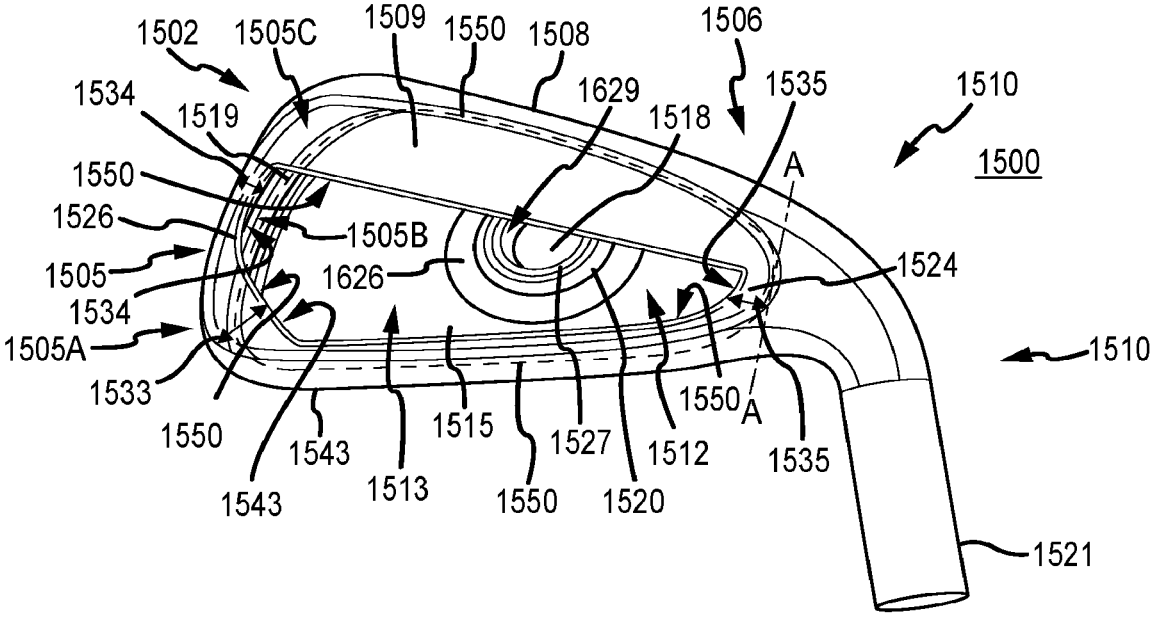
FIG. 20 is a rear view of the club head, according to the embodiment of FIG. 19.
Figure 21:
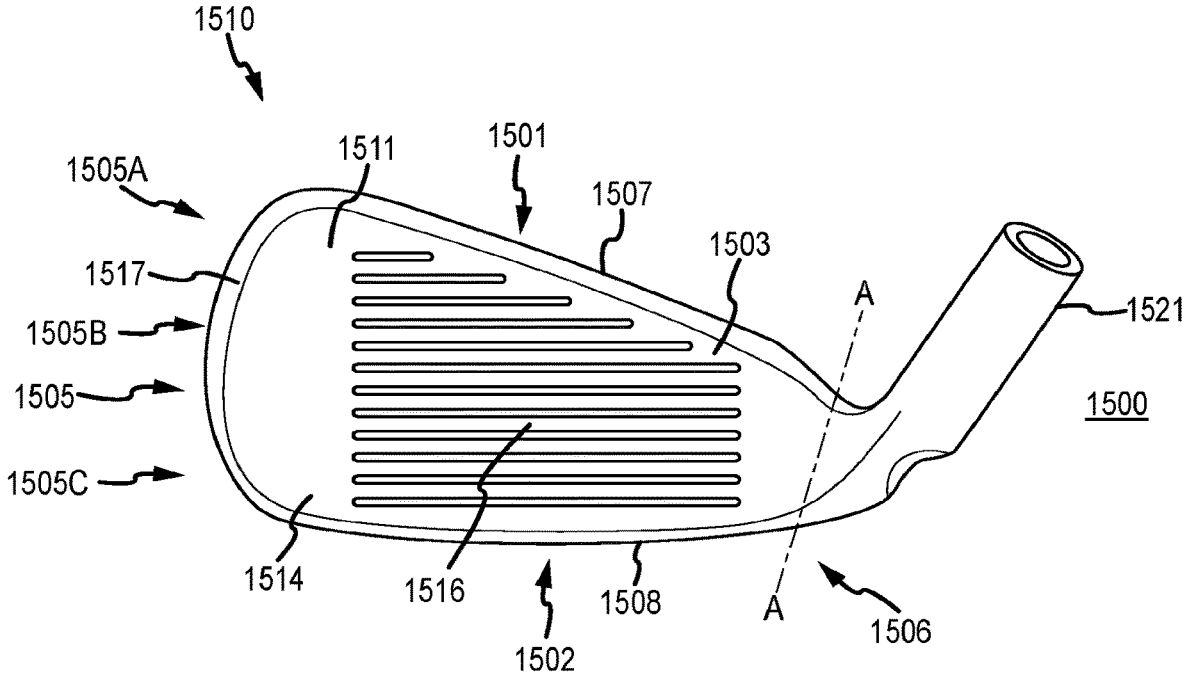
FIG. 21 is a front view of the club head, according to the embodiment of FIG. 19.

FIGS. 19-21 illustrate another embodiment of a club head 1500. FIG. 19 is a cross-sectional side view of club head 1500, while FIG. 20 is a rear perspective view of club head 1500, and FIG. 21 is a front view of club head 1500. Club head 1500 comprises a club head body 1510. As illustrated in FIG. 19, club head body 1510 can be similar to club head body 110, and 910, wherein club head body 1510 comprises a top end 1501, a bottom end 1502 opposite the top end 1501, a front end 1503, a rear end 1504 opposite the front end 1503, a toe end 1505, a heel end 1506 end opposite the toe end 1505, and a face element 1511. The toe end is further divided into a first toe end portion 1505A, a second toe end portion 1505B, and a third toe end portion 1505C. The first toe end portion 1505A is located adjacent and integral formed with the top end 1501. The third toe portion 1505C is located adjacent and integrally formed with the bottom end 1502. The second toe end portion 1505B is located between the first toe end portion 1505A, and the third toe end portion 1505C.

The club head 1500 further comprises a hosel 1521. The hosel 1521 is integrally formed with the club head body 1510. As illustrated in FIGS. 20 and 21, dashed line A-A represents the junction of the hosel 1521 and the club head body 1510, wherein the club head body 1510 ends and the hosel 1521 begins when the face element 1511 transitions from a flat surface to a curve.

In many embodiments, the face element 1511 of the club head body 1510 comprises a face surface 1514 positioned on the front end 1503, and a rear surface 1515 positioned on the rear end 1504 opposite the face surface 1514. The face surface 1514 can refer to a striking face or a striking plate of club head 1500, and be configured to impact a golf ball (not shown). The face surface 1514 comprises a face center 1516 located at a general center of the face surface 1514, and a face perimeter 1517 along the periphery of the face surface 1514, wherein the face perimeter 1517 abuts against the dashed line A-A at the heel end 1506 of the club head body 1510. The rear surface 1515 of the face element 1511 comprises a rear center 1518 opposite the face center 1516, and a rear perimeter 1519 opposite the face perimeter 1517, wherein the rear perimeter 1519 abuts against the dashed line A-A at the heel end 1506 of the club head body 1510.

FIG. 19 illustrates the rear end 1504 of the club head body 1510, wherein several cavities can be formed between the rear surface 1515 and along the perimeter of the face element 1511 and several back wall structures described in more details below. In many embodiments, these cavities are all integral with one another and connect together to form a 360 degree undercut between the rear surface 1515 an the several back wall structures. The several back wall structures form from the top end 1501, the bottom end 1502, the toe end 1505, and the heel end 1506 of the club head body 1510. In other embodiments, some of the cavities can be integral with one another and connect together, while other cavities are interrupted by structures (e.g., ribs, ledges, walls, or any other separating-type structures). In many embodiments, the club head body 1510 comprising the cavities formed can further comprise a reinforcement device 1512 (as described in more details below). In other embodiments, the golf club head comprising the cavities formed can be devoid of the reinforcement device 1512.

Club Head With Undercut

As illustrated in FIGS. 19 and 20, the top end 1501 of the club head body 1510 comprises a top rail 1507. The top rail 1507 extends in an arcuate fashion toward the rear end 1504 and the bottom end 1502 to form a top rail wall 1513. The curvature of the top rail wall 1513 covers a portion of the rear surface 1515, wherein a first cavity 1541 is formed between the rear surface 1515 and the top rail wall 1513. The top rail wall 1513 can extend from the heel end 1506 to the toe end 1505; likewise, the first cavity 1541 at the top end 1501 can extend from the heel end 1506 to the toe end 1505. The top rail wall 1513 can cover approximately 10% to 22% of the rear surface 1515. For example, the top rail wall 1513 can cover approximately 10%, 12%, 14%, 16%, 18%, 20%, or 22% of the rear surface 1515. In some embodiments, the top rail wall 1513 can cover napproximately 18% of the rear surface 1515. This percent coverage of the rear surface 1515 by the top rail wall 1513 is related to a first depth 1531 of the first cavity 1541.

As illustrated in FIG. 19, the first depth 1531 of the first cavity 1541 is measured from the opening of the first cavity 1541 to the rear perimeter 1519 at the top of the top rail 1507, parallel to the face surface 1514. The first depth 1531 can be a consistent depth or varies along the first cavity 1541. The first depth 1531 of the first cavity 1541 at the top rail 1507 can range from approximately 0.115 inch to 0.135 inch. For example, the first depth 1531 of the first cavity 1541 can be approximately 0.115 inch, 0.117 inch, 0.119 inch, 0.121 inch, 0.123 inch, 0.0125 inch, 0.127 inch, 0.129 inch, 0.131 inch, 0.133 inch, or 0.135 inch. In some embodiments, the first depth 1531 is approximately 0.125 inch.

The bottom end 1502 of the club head body 1510 comprises a sole 1508 that integrally forms into a rear portion 1509 extending upward toward the top end 1501 over a portion of the rear surface 1515. The rear upward extension of the rear portion 1509 over the rear surface 1515 forms a second cavity 1542 between the rear surface 1515 and the rear portion 1509. The rear portion 1509 can extend from the heel end 1506 to the toe end 1505; likewise, the second cavity 1542 between the rear surface 1515 and the rear portion can extend from the heel end 1506 to the toe end 1505. The rear portion 1509 can cover approximately 30% to 55% of the rear surface 1515. For example, the rear portion 1509 can cover approximately 30%, 35%, 40%, 45%, 50%, or 55% of the rear surface 1515. In some embodiments, the rear portion 1509 extending upward toward the top end 1501 can cover approximately 45% of the rear surface 1515. This percent coverage of the rear portion 1509 over the rear surface 1515 is related to a second depth 1532 of the second cavity 1542.

As illustrated in FIG. 19, the second depth 1532 of the second cavity 1542 is measured from the opening of the second cavity 1542 to the rear perimeter 1519 at the bottom of the sole 1508, parallel to the face surface 1514. The second depth 1532 can be a consistent depth or varies along the second cavity 1542. The second depth 1532 of the second cavity 1542 can range from approximately 0.460 inch to 0.580 inch. For example, the second depth 1532 can be approximately 0.460 inch, 0.480 inch, 0.500 inch, 0.520 inch, 0.540 inch, 0.560 inch or 0.580 inch. In some embodiments, the second depth 1532 of the second cavity 1542 can be approximately 0.500 inch.

At the toe end 1505 of the club head body 1510, as illustrated in FIG. 20, a toe ledge 1526 can extend in a curved manner toward the top rail 1507, the sole 1508, and the heel end 1506. The toe ledge 1526 extends from the top end 1501 toward the bottom end 1502, wherein the toe ledge is integrally formed with the rear portion 1509 of the sole 1508, and the top rail wall 1513 of the top rail 1507. More specifically, the toe ledge 1526 at the first toe end portion 1505A is adjacent and integrally formed with the top rail 1507, and the toe ledge 1526 at the third toe end portion 1505C is adjacent and integrally formed with the rear portion 1509. The toe ledge 1526 extending toward the top rail 1507 and the heel end 1506 can form a third cavity 1543 between the rear surface 1515 and the toe ledge 1526 at the first toe end portion 1505A. The third cavity 1543 is adjacent to and can be integral to the first cavity 1541 at the top rail 1507. Below the third cavity 1543, a fourth cavity 1544 can further be formed between the rear surface 1515 and the toe ledge 1526 at the second toe end portion 1505B.The fourth cavity 1544 is adjacent to and can be integral with the second cavity 1542 at the sole 1508.

The toe ledge 1526 can cover a portion of the rear surface 1515. More specifically, the toe ledge 1526 at the first toe end portion 1505A can cover approximately 7% to 15% of the rear surface 1515. For example the toe ledge 1526 at the first toe end portion 1505A can cover approximately 7%, 9%, 11%, 13%, or 15% of the rear surface 1515. In some embodiments, the toe ledge 1526 at the first toe end portion 1505A covers approximately 9% of the rear surface 1515. The percent coverage of the toe ledge 1526 is greatest and most pronounced at the first toe end portion 1505A; likewise a third depth 1533 (explained in greater detail below) of third cavity 1543 associated with the percent coverage of the toe ledge 1526 at the first toe end portion 1505A is very also pronounced. The percent coverage by the toe ledge at the first end is more pronounce, this can help to increase the top/toe weighting to improve the moment of inertia. The percent coverage by the toe ledge 1526 at the first toe end portion 1505A decreases toward the second toe end portion 1505B, wherein the percent coverage of the toe ledge 1526 at the second toe end portion 1505B is the smallest of the two.

As illustrated in FIG. 20, the third cavity 1543 of the toe end 1505 and adjacent to the top rail 1507 comprises the third depth 1533. The third depth 1533 is measured from the opening of the third cavity 1543 to the rear perimeter 1519 at the edge first toe end portion 1505A, parallel to the face surface 1514. The third depth 1533 can be a consistent depth or varies along the third cavity 1543. The third depth 1533 of the third cavity 1543 can range from approximately 0.215 inch to 0.245 inch. For example, the third depth 1533 can be approximately 0.215 inch, 0.219 inch, 0.223 inch, 0.227 inch, 0.231 inch, 0.235 inch, 0.239 inch, 0.243 inch, or 0.245 inch. In some embodiments, the third depth 1533 of the third cavity 1543 can be approximately 0.230 inch.

The fourth cavity 1544 of the toe end 1505 and adjacent to the sole 1508 is associated with the toe ledge 1526 at the second toe end portion 1505B. The toe ledge 1526 at the second toe end portion 1505B can cover a portion of the rear surface 1515 ranging from approximately 4% to 10%. For example. The toe ledge 1526 at the second toe end portion 1505B can cover approximately 4%, 5%, 6%, 7%, 8%, 9%, or 10% of the rear surface 1515. In some embodiments, the toe ledge 1526 at the second toe end portion 1505B can cover approximately 5% of the rear surface 1515. The percent coverage of the toe ledge 1526 is the least at the second toe end portion 15050B; similarly, a fourth depth 1534 (described in more details below) of the fourth cavity 1544 associated with the percent coverage of the toe ledge 1526 at the second toe end portion 1505B is also very small. The percent coverage of the toe ledge 1526 at the second toe end portion 1505B is much smaller than the percent coverage at the first toe end portion 1505A. In other embodiments, the percent coverage of the rear surface 1515 at the second toe end portion 1505B can be greater, or the same as the percent coverage of the rear surface 1515 at the first toe end portion 1505A. The percent coverage of the toe ledge 1526 at the second toe end portion 1505B is kept substantially constant and slightly increases toward the third toe end portion 1505C until it integrally forms with the rear portion 1509.

The fourth cavity 1544 of the toe end 1505 between the third cavity 1543 adjacent the top rail 1507, and the second cavity 1542 at the sole 1508 comprises the fourth depth 1534. The fourth depth 1534 is the distance measured from the opening of the fourth cavity 1544 to the rear perimeter 1519 at edge of the second toe end portion 1505B, parallel to the face surface 1514. It can be seen the fourth depth 1534 varies along the fourth cavity 1544, but in other embodiments, could also be consistent along the fourth cavity 1544. The fourth depth 1534 of the fourth cavity 1544 can range from approximately 0.140 inch to 0.165 inch. For example, the fourth depth 1534 can be approximately 0.140 inch, 0.144 inch, 0.148 inch, 0.152 inch, 0.156 inch, 0.160 inch, or 0.165 inch. In some embodiments, the fourth depth 1534 of the fourth cavity 1544 can be approximately 0.150 inch. As stated above, the fourth depth 1534 of the fourth cavity 1544 is correlated with the percent of the rear surface 1515 covered by the toe ledge 1526 at the second toe end portion 1505B. Because the percent coverage of the rear surface 1515 by the toe ledge 1526 is smaller at the second toe end portion 1505B than at the first toe end portion 1505A, thereby the fourth depth 1534 is smaller than the third depth 1533. In other embodiments, wherein the percent coverage of the rear surface 1515 by the toe ledge 1526 is greater at the second toe end portion 1505B than the first toe end portion 1505A, the fourth depth 1534 can also be greater than the third depth 1533. In other embodiments, wherein the percent coverage of the rear surface 1515 by the toe ledge 1526 is the same at the second toe end portion 1505B and the first toe end portion 1505A, the fourth depth 1534 can also be the same as the third depth 1533.

At the heel end 1506 of the club head body 1510 a heel ledge 1524 can extend in a curved manner toward the top rail 1507, the sole 1508, and the toe end 1505. A fifth cavity 1545 is formed between the rear surface 1515 and the heel ledge 1524. The heel ledge 1524 extends from the top end 1501 to the bottom end 1502 and is integrally formed with the top rail 1507, and the rear portion 1509. The heel ledge 1524 can cover a portion of the rear surface 1515. The heel ledge 1524 can cover approximately 3% to 8% of the rear surface 1515. For example, the heel ledge 1524 can cover approximately 3%, 4%, 5%, 6%, 7%, or 8% of the rear surface 1515. In some embodiments, the heel ledge 1524 can cover approximately 4% of the rear surface 1515. The percent coverage of the heel ledge 1524 over the rear surface 1515 is related to a fifth depth 1535 of the fifth cavity 1545.

As illustrated in FIG. 20, the fifth depth 1535 of the fifth cavity 1545 is measured from the opening of the fifth cavity 1545 to the rear perimeter 1519 at the heel end 1506 (abutting the dashed line A-A), parallel to the face surface 1514. The fifth depth 1535 can be a consistent depth or varies along the fifth cavity 1545. The fifth depth 1535 of the fifth cavity 1545 can range from approximately 0.080 inch to 0.110 inch. For example, the fifth depth 1535 can be approximately 0.080 inch, 0.082 inch, 0.084 inch, 0.086 inch, 0.088 inch, 0.090 inch, 0.092 inch, 0.094 inch, 0.096 inch, 0.098 inch, 0.100 inch 0.102 inch, 0.104 inch, 0.106 inch, 0.108 inch, or 0.110 inch. In some embodiments, the fifth cavity 1545 can have a fifth depth 1535 of approximately 0.100 inch.

As illustrated in FIG. 20, the first cavity 1541, second cavity 1542, third cavity 1543, fourth cavity 1544, and fifth cavity 1545 as describe above are all integrally connected with one another, defining a continuous 360 degree undercut 1550. In the exemplary embodiment, the undercut 1550 can comprises the first cavity 1541, the second cavity 1542, the third cavity 1543, the fourth cavity 1544, and the fifth cavity 1545. The undercut 1550 further comprises 100% of the rear perimeter 1519 of the face element 1511 of the club head body 1510. The undercut 1550 of the club head body 1510 can help save weight as well as increase bending within the face element 1511. In other embodiments, the cavities (e.g., first cavity 1541, second cavity 1542, third cavity 1543, fourth cavity 1544, and fifth cavity 1545) can be disconnected in any combination wherein the undercut 1550 comprises 70% to 100% of the rear perimeter 1519. For example, the cavities can be interrupted and non-continuous between the first cavity 1541 and the second cavity 1542, or between the third cavity 1543 and the fourth cavity 1544, or any combination of the first, second, third, fourth, and fifth cavities 1541, 1542, 1543, 1544, and 1545. In some embodiments, the interruption between the cavities can be structures (not pictured) such as ribs, lips, ledges, walls, protrusions, or any other interrupting structures. In these exemplary embodiments, the undercut 1550 can comprise 70%, 75%, 80%, 85%, 90%, 95% or 100% of the rear perimeter 1519.

The face element 1511 of the club head body 1510 comprising the several cavities described above to form a 360 undercut 1550 can further comprise a face thickness. The face thickness of the face element 1511 can help distribute stress and allow for further face inflection during ball impact along with the undercut 1550. In many embodiments, the face thickness of the face element 1511 can vary from the toe end 1505 to the heel end 1506, from the top end 1501 to the bottom end 1502, or any combination thereof.

As illustrated in FIG. 19, the face thickness of the face element 1511 can comprise a first thickness 1551, a second thickness 1552, a third thickness 1553, and a fourth thickness 1554. The first thickness 1551 of the face element is measured perpendicular from the face center 1516 to the rear center 1518. The first thickness 1551 can range from approximately 0.055 inch to 0.075 inch, 0.055 inch to 0.065 inch, 0.065 inch to 0.075 inch, or 0.060 inch to 0.070 inch. For example, the first thickness 1551 can be 0.055 inch, 0.057 inch, 0.059 inch, 0.061 inch, 0.063 inch, 0.065 inch, 0.067 inch, 0.069 inch, 0.071 inch, 0.073 inch, or 0.075 inch. In some embodiments, the first thickness 1551 of the face element 1511 can be approximately 0.065 inch.

As illustrated in FIG. 19, the second thickness 1552 is the face thickness measured perpendicular from the face surface 1514 to an apex of a reinforcement elements 1520 (described in more detail below). In some embodiments devoid of the reinforcement device 1512, the second thickness is measured perpendicular from the face surface 1514 to the rear surface 1515 adjacent the rear center 1518. The second thickness 1552 can range from approximately 0.150 inch to 0.200 inch, 0.150 inch to 0.160 inch, 0.160 inch to 0.170 inch, 0.170 inch to 0.180 inch, 0.180 inch to 0.190 inch, 0.190 inch to 0.200 inch, 0.150 inch to 0.175 inch, or 0.175 inch to 0.200 inch. For example, the second thickness 1552 can be approximately 0.150 inch, 0.155 inch, 0.160 inch, 0.165 inch, 0.170 inch, 0.175 inch, 0.180 inch, 0.185 inch, 0.188 inch, 0.190 inch, 0.195 inch or 0.200 inch. In some embodiments, the second thickness 1552 of the face element 1511 can be approximately 0.188 inch.

As illustrated in FIG. 19, the third thickness 1553 is the face thickness devoid of the reinforcement device 1512 and adjacent the rear perimeter 1519 and distal the rear center 1518, measured perpendicular from the face surface 1514 to the rear surface 1515. The third thickness 1553 can range from approximately 0.050 inch to 0.060 inch, 0.060 inch to 0.070 inch, 0.070 inch to 0.080 inch, 0.080 inch to 0.090 inch, 0.090 inch to 0.100 inch, 0.050 inch to 0.75 inch, or 0.075 inch to 0.100 inch. For example, the third thickness 1553 can be approximately 0.050 inch, 0.55 inch, 0.060 inch, 0.065 inch, 0.070 inch, 0.075 inch, 0.080 inch, 0.085 inch, 0.088 inch, 0.090 inch, 0.095 inch, or 0.100 inch. In some embodiments, the third thickness 1553 of the face element 1511 can be approximately 0.088 inch.

As illustrated in FIG. 19, the fourth thickness 1554 is the face thickness measured perpendicular from the face surface 1514 to the very edge of the rear perimeter 1519 of the rear surface 1515. The fourth thickness 1554 can range from approximately 0.050 inch to 0.070 inch, 0.050 inch to 0.060 inch, 0.060 inch to 0.070 inch, 0.050 inch to 0.058 inch, 0.058 inch to 0.064 inch, or 0.064 inch to 0.070 inch. For example, the fourth thickness 1554 can be approximately 0.50 inch, 0.052 inch, 0.054 inch, 0.056 inch, 0.058 inch, 0.060 inch, 0.062 inch, 0.064 inch, 0.066 inch, 0.068 inch, or 0.070 inch. In some embodiments, the fourth thickness 1554 of the face element 1511 can be approximately 0.060 inch.

In some embodiments, the club head body 1510 can be void of a reinforcement device 1512 and reinforcement elements 1520. In these exemplary embodiments, the face element 1511 near the face center 1516 (the first thickness 1551 and the second thickness 1552) can comprise a face thickness greater than 0.088 inch (from approximately 0.088 inch to 0.100 inch, 0.088 inch to 0.220 inch, 0.100 inch to 0.220 inch, or 0.140 inch to 0.180 inch) inch to absorb distribute stress. For example, the face element 1511 near the face center 1516 can comprise a first thickness 1551, and a second thickness 1552 of approximately 0.088 inch, 0.090 inch, 0.092 inch, 0.094 inch, 0.096 inch, 0.098 inch, 0.100 inch, 0.110 inch, 0.114 inch, 0.180 inch, or 0.220 inch.

Club Head with Undercut and Reinforcement Device

In some embodiments, as illustrated in FIGS. 19 and 20, the club head body 1510 further comprises the reinforcement device 1512 similar to the reinforcement device 112, 612 and 912. In other embodiments, the club head body 1510 can be devoid of reinforcement device 1512. The reinforcement device 1512 is located on the rear surface 1515 of the face element 1511, generally at the rear center 1518. The reinforcement device 1512 extends from the rear surface 1515 away from the front end 1503. The reinforcement device 1512 comprises one or more reinforcement elements 1520. In many embodiments, each reinforcement element of the reinforcement elements 1520 comprises an outer perimeter surface 1626, an inner perimeter surface 1629, and a geometric center. The reinforcement element 1520 further comprises looped ribs 1627. In these or other embodiments, the geometric center(s) of one or more of reinforcement elements 1520 can be at the rear center 1518 of the rear surface 1515.

In some embodiments, looped ribs 1527 can comprise multiple looped ribs, wherein each looped rib 1527 can be concentric with each other. In other embodiments, when looped ribs 1527 comprise multiple looped ribs, two or more of looped ribs 1527 can be nonconcentric. Further, in these or other embodiments, two or more of looped rib 1527 can overlap. Meanwhile, in some embodiments, looped ribs 1527 can comprise an elliptical looped rib, and in other embodiments, looped ribs 1527 can comprise a circular looped rib.

In implementation, reinforcement element(s) 1520 and looped ribs 1527 can be implemented in any suitable shape(s) (e.g., polygonal, elliptical, circular, etc.) and/or in any suitable arrangement(s) configured to perform the intended functionality of reinforcement device 1512 and/or reinforcement element(s) 1520 as described above. Further, when reinforcement element(s) 1520 comprise multiple reinforcement elements, two or more reinforcement elements of reinforcement element(s) 1520 can be similar to another, and/or two or more reinforcement elements of reinforcement element(s) 1520 can be different from another.

In some embodiments, one or more outer perimeter surfaces 1626 of reinforcement elements 1520 can be filleted with rear surface 1515. In these or other embodiments, one or more inner perimeter surfaces 1629 of looped ribs 1627 can be filleted with rear surface 1515. Filleting the outer perimeter surface 1626 of reinforcement elements 1520 with rear surface 1515 can permit a smooth transition of reinforcement elements 1520 into rear surface 1515. Further, filleting the outer perimeter surface 1626 of reinforcement elements 1520 with rear surface 1515 can direct stresses from impact into reinforcement elements 1520 and away from the face surface 1514. Meanwhile, outer perimeter surface 1626 of reinforcement elements 1520 or inner perimeter surface 1629 of looped ribs 1627 can be filleted with rear surface 1515 with a fillet 1523 having a radius of greater than or equal to approximately 0.012 centimeters. For example, in some embodiments, the fillet 1523 of the outer perimeter surface 1626 with the rear surface 1515 can range from approximately 0.012 centimeters to approximately 2.0 centimeters, from approximately 0.50 centimeters to approximately 3.0 centimeters, or from approximately 1.0 centimeters to approximately 4.0 centimeters. For further example, in some embodiments, the fillet 1523 of the inner perimeter surface 1629 with the rear surface 1515 can range from approximately 0.012 centimeters to approximately 2.0 centimeters, from approximately 0.50 centimeters to approximately 3.0 centimeters, or from approximately 1.0 centimeters to approximately 4.0 centimeters.

In some embodiments, the outer perimeter surface 1626 of reinforcement elements 1520 can be filleted directly with rear surface 1515. In these embodiments, the face thickness decreases gradually along the fillet 1523 from face thickness at the second face thickness 1552 (face surface 1514 to the apex of the reinforcement element 1520) to face thickness at rear surface 1515.

In some embodiments, club head 1500 can further include a lip (not pictured) on rear surface 1515 of club head 1500 similar to the lip 552 as described above and FIGS. 15-17. The lip of club head 1500 can extend from the heel end 1506 to the toe end 1505 around the reinforcement element 1520 of club head 1500. In these or other embodiments, a fillet 1523 on the outer perimeter surface 1626 of the reinforcement elements 1520 can transition to the lip such that the face thickness decreases gradually along the fillet 1523 from the second thickness 1552 to a minimum thickness between the lip and the reinforcement element 1520, then increases gradually from the minimum thickness to the an apex of the lip. In these embodiments, the minimum thickness between the reinforcement element 1520 and the lip can be greater than the first thickness 1551 at the face center 1516, the minimum thickness between the reinforcement element 1520 and the lip can be approximately equal to the first thickness 1551, or the minimum thickness between the reinforcement element 1520 and the lip can be less than the first thickness 1551.

As described previously, reinforcement device 1512 and reinforcement element(s) 1520 are configured to reinforce face element 1511 while still permitting face element 1511 to bend, such as, for example, when face surface 1514 impacts a golf ball. As a result, face element 1511 can be thinned to permit mass from face element 1511 to be redistributed to other parts of club head 1500 and to make face element 1511 more flexible without buckling and failing under the resulting bending. Advantageously, because face element 1511 can be thinner when implemented with reinforcement device 1512 and reinforcement element(s) 1520, the center of gravity, the moment of inertia, and the coefficient of restitution of club head 1500 can be altered to improve the performance characteristics of club head 1500. For example, implementing reinforcement device 1512 and reinforcement element(s) 1520 can increase a flight distance of a golf ball hit with face surface 1514 by increasing launch angle, increasing the ball speed, and/or decreasing spin of the golf ball. In these examples, reinforcement device 1512 and reinforcement element(s) 1520 can have the effect of countering some of the gearing on the golf ball provided by face surface 1514.

The reinforcement device 1512 and reinforcement element(s) 1520 are further able to provide stress reducing benefits when implemented as a closed structure (i.e., looped ribs 1527) because such closed structures are able to resist deformation as a result of circumferential (i.e., hoop) stresses acting on reinforcement device 1512 and reinforcement element(s) 1520. For example, circumferential (i.e., hoop) stresses acting on reinforcement device 1512 and reinforcement element(s) 1520 can prevent opposing sides of reinforcement device 1512 and reinforcement element(s) 1520 from rotating away from each other, thereby reducing bending.

The undercut 1550 of the club head body 1510 can produce similar performance characteristics of the reinforcement device 1512 as described above. In some embodiments, the club head body 1510 can be devoid of the reinforcement device 1512, wherein the club head body 1510 comprising the undercut 1550 can perform similar to a club head body 1510 with both the reinforcement device 1512, and the undercut 1550. The undercut extending in 360 degrees comprising the first cavity 1541, the second cavity 1542, the third cavity 1543, the fourth cavity 1544 and the fifth cavity 1545 allow for optimal bending and deflection of the face element 1511 during impact. In similar club head bodies void of a 360 degree undercut, the face element cannot bend or deflect as much. More specifically, similar club head bodies void of a third cavity 1543, a fourth cavity 1544, and/or a fifth cavity 1545 cannot bend or deflect at the heel end and at the toe end. The deflection of similar club heads are limited at the heel end 1506 and toe end 1505 is due to the rear surface of the face element not having any space to bend back. The 360 degree undercut 1550 of the club head body 1510 specifically comprising the third cavity 1543, and the fourth cavity 1544 at the toe end 1505, and the fifth cavity 1545 at the heel end 1506 prevents the rear surface 1515 of the face element 1511 from contacting the toe ledge 1526 and heel ledge 1524 during impact, thus the face element 1511 can freely bend for greater deflection. The fourth depth 1534 of the fourth cavity 1544 further prevents the rear surface 1515 of the face element 1511 from coming into contact with the toe ledge 1526 during impact for increased deflection; due to the small fourth depth 1534 of the fourth cavity 1543 (i.e., the toe ledge 1526 is not as pronounced), the face element 1511 near the toe end 1505 can extend farther back.

The deflection of the face element 1511 affects the coefficient of restitution (COR) of the club head 1500. The COR measures the elasticity of an object in collision and is the ratio of the object's final relative speed to the objects' initial relative speed. A higher COR results in increased ball speed and distance, and a lower COR results in decreased ball speed and distance. Therefore, the increased deflection of the 360 degree undercut 1550 of the club head 1500 affects the distance and speed of the ball after impact. As the undercut 1550 increases the deflection of the face element 1511, the distance and speed of the ball also increases.

Further still, the 360 degree undercut 1550 allows for removal of mass from the perimeter of the face element 1511 that experiences the least amount of stress (i.e., the rear perimeter 1519 between located between the rear surface 1515, and the rear portion 1509 top rail 1507, toe ledge 1526, and heel ledge 1524). The removed mass can then be redistributed to other locations on the club head 1500 (e.g., the bottom end 1502, near the toe end 1505, near the heel end 1506, or any combination thereof). The redistribution of mass can shift the center of gravity (CG) lower and back toward the rear end 1504, which can provide the club head with higher performance characteristics such as increased moment of inertia (MOI). The width of the first portion 1526A can further affect the mass distribution for CG and MOI. The width of the first portion 1526A as illustrated in FIG. 20 adds to the mass in the toe end 1505 to help improve MOI. Better CG placement and increased MOI can lead to increased ball speeds as well as prevent rotation of the club head 1500 from toe end 1505 to heel end 1506. Preventing the rotation of the club head 1500 from toe end 1505 to heel end 1506 allows for better contact with the ball upon impact, which can result in optimal ball speed, spin, and trajectory. In some embodiments to further effect the CG, a weight (not pictured) can be disposed within the second cavity 1542 between the rear surface 1515 and the rear portion 1509. The weight positioned within the second cavity 1542 allows the CG to shift toward the rear end 1504 and the sole 1508. The weight disposed within the second cavity 1542 can further absorb stress and vibration experienced by the club head body 1510 during impact. Stress and vibration absorbing by the weight can help maintain the durability and structural integrity of the club head body 1510 as well as improve feel for a player.

The club head body 1510 can further comprise a cascading sole 1555 located on an inner cavity the sole 1508 at the bottom of the second cavity 1542 located between the rear portion 1509 and the rear surface 1515. The cascading sole 1555 of club head body 1510 can be similar to the cascading sole 955 of club head body 910 as described above having a first tier (not pictured) and a second tier (not pictured). The cascading sole 1555 of club head body 1510 allows some of the stress experienced by the face element 1511 near the sole 1508, to distribute to the first tier and the second tier of the club head body 1510. The first tier and the second tier of the cascading sole 1555 of club head body 1510 prevent the stress from collecting primarily at the thinnest section of the face element 1511 near the sole 1508. The distribution of stresses in the first tier and the second tier in the sole 1508 can prevent permanent deformation of the face element 1511, thus more consistent performance characteristic and feel after a plurality of impacts with the ball.

The golf club head 100, 300, 600, 800, 900, 1500 can be part of a set of club heads having varying loft angles. In some embodiments, center thickness 537, face thickness 542 outside reinforcement element 120, top thickness 546, bottom thickness 548, face thickness at rib height 540, or a combination of the described thicknesses can vary with loft angle of the club heads within the set of club heads.

Figure 10:
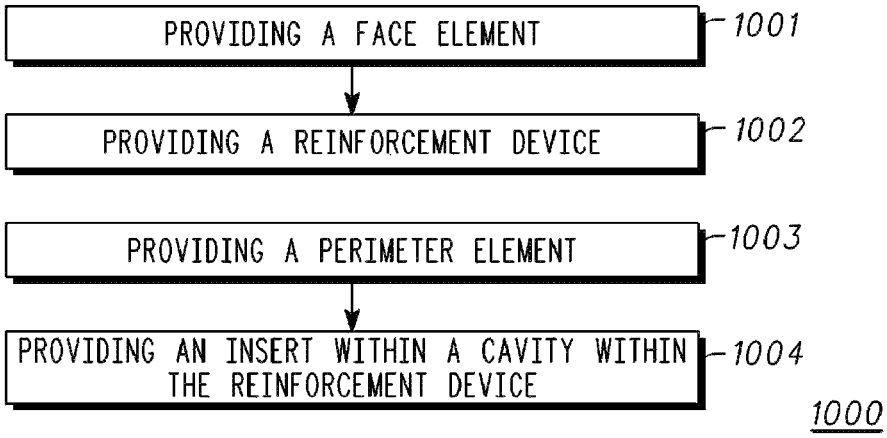
FIG. 10 illustrates a flow chart for an embodiment of a method of providing a golf club head.

Turning now to the next drawing, FIG. 10 illustrates a flow chart for an embodiment of method 1000 of providing a golf club head. Method 1000 is merely exemplary and is not limited to the embodiments presented herein. Method 1000 can be employed in many different embodiments or examples not specifically depicted or described herein. In some embodiments, the activities, the procedures, and/or the processes of method 1000 can be performed in the order presented. In other embodiments, the activities, the procedures, and/or the processes of method 1000 can be performed in any other suitable order. In still other embodiments, one or more of the activities, the procedures, and/or the processes in method 1000 can be combined or skipped. In many embodiments, the golf club head can be similar or identical to golf club head 100 (FIGS. 1 & 2), golf club head 600 (FIGS. 6 & 7), and/or golf club head 800 (FIGS. 8 & 9).

Method 1000 can comprise an activity 1001 of providing a face element. The face element can be similar or identical to face element 111 (FIG. 1).

Figure 11:
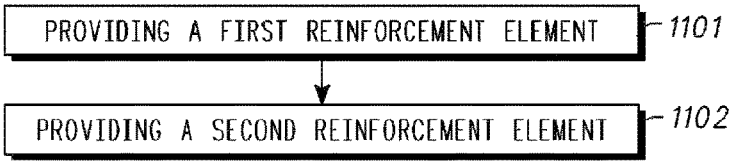
FIG. 11 illustrates an exemplary activity of providing a reinforcement device, according to the embodiment of FIG. 10.

Method 1000 can comprise an activity 1002 of providing a reinforcement device. The reinforcement device can be similar or identical to reinforcement device 112 (FIG. 1). FIG. 11 illustrates an exemplary activity 1002, according to the embodiment of FIG. 10.

For example, activity 1002 can comprise an activity 1101 of providing a first reinforcement element. The first reinforcement element can be similar or identical to first reinforcement element 121 (FIG. 1), reinforcement element 621 (FIG. 6), any one reinforcement element of reinforcement element(s) 120 (FIG. 1), and/or any one reinforcement element of reinforcement element(s) 620 (FIG. 6).

Further, activity 1002 can comprise an activity 1102 of providing a second reinforcement element.

The second reinforcement element can be similar or identical to second reinforcement element 641 (FIG. 6) and/or any one reinforcement element of reinforcement element(s) 620 (FIG. 6). In some embodiments, activity 1101 and activity 1102 can be performed approximately simultaneously. In other embodiments, activity 1102 can be omitted.

Turning back to FIG. 10, method 1000 can comprise an activity 1003 of providing a perimeter wall element. The perimeter wall element can be similar or identical to perimeter wall element 113 (FIG. 1). In some embodiments, activity 1003 can be omitted.

In some embodiments, method 1000 can comprise an activity 1004 of providing an insert within a central cavity within the reinforcement device provided in activity 1002. In some embodiments, activity 1004 can be omitted.

In many embodiments, two or more of activities 1001-1004 can be performed sequentially or can be performed approximately simultaneously with each other. In these or other embodiments, activities 1001-1004 can be performed implementing any suitable manufacturing techniques (e.g., casting, forging, molding, machining, joining, etc.).

Although the golf club head(s) and related methods herein have been described with reference to specific embodiments, various changes may be made without departing from the spirit or scope of the present disclosure. For example, to one of ordinary skill in the art, it will be readily apparent that activities 1001-1004 of FIG. 10 and activities 1101 and 1102 of FIG. 11 may be comprised of many different procedures, processes, and activities and be performed by many different modules, in many different orders, that any element of FIGS. 1-4 may be modified, and that the foregoing discussion of certain of these embodiments does not necessarily represent a complete description of all possible embodiments.

EXAMPLES

Example 1

360 Degree Undercut vs. Partial Undercut

Referring to Table 1 below, a Finite Element Analysis (FEA) test was done to evaluate the internal energy (measured in lbf·inches) of two similar golf club heads during impact with a golf ball at 90 mph. Three points of impact on the face element of the golf club heads were chosen for the FEA test, the toe end, the face center, and the heel end. The first golf club head tested was club head 1500, which comprised the 360 degree undercut 1550 wherein the undercut 1550 is continuous and comprises the first, second, third, fourth, and fifth cavities 1541, 1542, 1542, 1544, and 1545 as described above of club head body 1510. For comparative measure, the control golf club head used was similar in size and structure, comprising an cavity within the top rail, and the sole, but was devoid of a 360 degree undercut (i.e., devoid of a cavity in the heel end and the toe end).

TABLE 1

Deflection and Ball Speed Performance of Club Head 1500 vs. Control

| | Peak Face Element Bending (inches) | Ball Speed At The Heel End (mph) | Ball Speed At The Center (mph) | Ball Speed At The Toe End (mph) |
|---|---|---|---|---|
| Club Head 1500 | 0.040-0.050 | 123.0 | 125.3 | 123.2 |
| Control Club Head | 0.030-0.040 | 122.4 | 124.3 | 121.9 |

The FEA test measured the internal energy produced by the face element, wherein 7.8 lbf·inches equated to approximately 1 mph. As shown in Table 1 above, the golf club head produced golf ball speeds of approximately 123.0 mph at the heel end 1506, approximately 125.3 mph at the face center 1516, and approximately 123.2 mph at the toe end 1505. Compared to the club head 1500, the control golf club head produced slower golf ball speeds of approximately 122.4 mph at the heel end, approximately 124.3 mph at the face center, and approximately 121.9 mph at the toe end. The club head 1500 comprised of the full 360 undercut 1550 comprising the integrally continuous first cavity 1541, second cavity 1542, third cavity 1543, fourth cavity 1544, and fifth cavity 1545 had an increase in ball speed in all three points tested, compared to the similar control golf club head with only a cavity in the top rail and the sole (i.e., devoid of a cavity in the heel end and the toe end). More specifically, the club head 1500 had an increase of approximately 0.5-0.75 mph (approximately 0.5% increase) in the heel end 1506, an increase of approximately 1 mph (approximately 0.8% increase) in the face center, and an increase of approximately 1-1.5 mph (approximately 1.1% increase) in the toe end 1505 over the control golf club head.

The FEA test further showed the peak deflection the face elements of the golf club heads experienced during impact with the golf ball. The peak deflection was measured in FEA from a face surface of the face element at a starting position to the face surface of the face element at an end of impact position, prior to the face element rebounding back to the start position. The face element 1511 of the club head 1500 having the 360 degree undercut experienced a peak deflection of 0.040 inch to 0.050 inch, while the face element of the control golf club head had a cavity in the top rail, and a cavity in the sole, but devoid of the cavity in the heel end and the toe end experienced a peak deflection of 0.030 inch to 0.040 inch. Therefore, the face element 1511 of the club head 1500 having the 360 degree undercut has a 28.6% increase in peak deflection.

As shown in Table 1 and explained above, the club head 1500 increased ball speed in the heel end 1506, the face center 1516, and the toe end 1505, as well as increased peak deflection of the face element 1511 compared to the control golf club head. The increased performance results of the club head 1500 are due mainly to the 360 undercut 1550 comprised of the first cavity 1541, the second cavity 1542, the third cavity 1543, the fourth cavity 1544, and the fifth cavity 1545; this is compared to the similarly structured and sized control golf club head that had a cavity in the top rail and a cavity in the sole but was devoid of the cavity in the heel end and the toe end.

A continuous 360 degree undercut 1550, specifically comprising the third and fourth cavities 1543, and 1544 at the toe end 1505, and the fifth cavity 1545 at the heel end 1506, allowed more room for the face element 1511 to deflect. Therefore, more internal energy was produced, which equates to more ball speed. A higher ball speed can result in other performance characteristics, such as launch angle ball spin and tightening the statistical area in which the ball lands, which all effect the distance of the ball during a game. More specifically, the increase ball speed experienced by the club head 1500 can equate to a 0.1 to 0.3 degree higher launch angle and a 100 revolutions per minute (rpm) to 300 rpm lower ball spin compared to the similar control club had with only the top rail and sole cavities. A higher launch angle and lower ball spin can increase the distance the ball travels after impact. The increase in launch angle and decrease in spin rate of the club head 1500 comprising the first, second, third, fourth, and fifth cavities 1541, 1542, 1542, 1544, and 1545 had an increase of 2 yards to 5 yards of ball distance compared to the control club head devoid of a toe and heel end cavity.

The club head 1500 comprised of the 360 degree undercut 1550 not only increased in ball speed, but maintained a similar MOI as the control club head with only the top rail and sole cavities. Having a similar MOI as a club head with lower balls speeds means the club head 1500 can behave as a more forgiving club without giving up faster ball speeds. The club head 1500 is further forgiving, due to more consistent ball speeds across the face element 1511 (from the toe end 1505 to the heel end 1506). A more consistent ball speed across the face element 1511 can thereby produce more consistent ball flight and distance during mishits (i.e., impact at the heel end 1506 or the toe end 1505).

Further, while the above examples may be described in connection with an iron-type golf club head, the apparatus, methods, and articles of manufacture described herein may be applicable to other types of golf clubs such as a wood-type golf club or a putter-type golf club. Alternatively, the apparatus, methods, and articles of manufacture described herein may be applicable other type of sports equipment such as a hockey stick, a tennis racket, a fishing pole, a ski pole, etc.

Additional examples of such changes and others have been given in the foregoing description. Other permutations of the different embodiments having one or more of the features of the various figures are likewise contemplated. Accordingly, the specification, claims, and drawings herein are intended to be illustrative of the scope of the disclosure and is not intended to be limiting. It is intended that the scope of this application shall be limited only to the extent required by the appended claims.

Clause 1: A golf club head comprising a front end and a rear end, a face element comprising a face surface located at the front end and a rear surface located at the rear end, wherein the rear surface comprises a rear center, a rear perimeter, and a reinforcement device, a top end having a top rail extending in an arcuate fashion toward the bottom end to form a top rail wall, a bottom having a sole integrally forming into a rear portion extending upward toward the top end, a toe end divided into a first toe end portion, a second toe end portion, and a third toe end portion, wherein the first toe end portion is adjacent and integrally formed with the top end, the third toe end portion is adjacent and integrally formed with the bottom end, and the second toe end portion is positioned between the first toe end portion and the third toe end portion, and wherein the toe end has a toe ledge extending in a curved manner toward the top rail, the sole, and the heel end, the toe ledge is integrally formed with the top rail wall and the rear portion, a heel end comprising a heel ledge extending in a curved manner toward the top rail, the sole, and toe end, wherein the heel ledge is integrally formed with the top rail wall and the rear portion, an undercut comprising a first cavity, a second cavity, a third cavity, a fourth cavity, and a fifth cavity, wherein the first cavity is formed between the rear surface and the top rear wall, the first cavity having a first depth ranging from 0.115 inch to 0.135 inch, the second cavity is formed between the rear surface and the rear portion, the second cavity having a second depth ranging from 0.460 inch to 0.580 inch, the third cavity is formed between the rear surface and the toe ledge at the first toe end portion having a third depth ranging from 0.215 inch to 0.245 inch, the fourth cavity is formed between the rear surface and the toe ledge at the second to end portion having a fourth depth ranging from 0.140 inch to 0.165 inch, the fifth cavity is formed between the rear surface and the heel ledge, the fifth cavity having a fifth depth ranging from 0.080 inch to 0.110 inch, the reinforcement element comprises a looped rib having an outer perimeter surface and an inner perimeter surface, and the outer perimeter surface of the reinforcement element is filleted with the rear surface.

Clause 2: The golf club head of clause 1 wherein the looped rib is symmetric about the x-axis, or the looped rib is symmetric about the y-axis.

Clause 3: The golf club head of clause 1 wherein the first cavity, second cavity, third cavity, fourth cavity, and fifth cavity are all integrally connected and continuous.

Clause 4: The golf club head of clause 1 wherein the first cavity, second cavity third cavity, fourth cavity, and fifth cavity are interrupted and non-continuous by an interrupting structure.

Clause 5: The golf club head of clause 1 wherein the face element comprises a first thickness, measured perpendicular from a face center of the face surface to the rear center, ranging from 0.055 inch to 0.075 inch, the face element comprises a second thickness, measured perpendicular from an apex of the reinforcement element to the face surface, ranging from 0.150 inch to 0.200 inch, the face element comprises a third thickness, measured perpendicular from the face surface to the rear surface devoid of the reinforcement device and adjacent the rear perimeter and rear center, ranging from 0.050 inch to 0.060 inch, and the face element comprises a fourth thickness at the rear perimeter ranging from 0.050 inch to 0.070 inch.

Clause 6: The golf club head of clause 1 further comprises a cascading sole at the bottom of the second cavity, wherein the cascading sole comprises a first tier and a second tier.

Clause 7: The golf club head of clause 6 wherein the first tier comprises a greater thickness than a thickness of the second tier.

Clause 8: The golf club head of clause 1 wherein the inner perimeter surface of the looped rib is filleted with the rear surface.

Clause 9: The golf club head of clause 1 wherein the first depth of the first cavity is approximately 0.125 inch, the second depth of the second cavity is approximately 0.500 inch, the third depth of the third cavity at the first toe end portion is approximately 0.225 inch, the fourth depth of the fourth cavity at the second toe end portion is approximately 0.120 inch, and the fifth depth of the fifth cavity at the heel end is approximately 0.080 inch.

Clause 10: The golf club head of clause 1 wherein the toe ledge covers a percentage of the rear surface, wherein the toe ledge is most pronounced at the first toe end portion, decreases toward the second toe end portion, is substantially constant, and slightly increases toward the third toe end portion.

Clause 11: A golf club head comprising a front end and a rear end, a face element comprising a face surface located at the front end and a rear surface located at the rear end, wherein the rear surface comprises a rear center, and a rear perimeter, a top end having a top rail extending in an arcuate fashion toward the bottom end to form a top rail wall, a bottom having a sole integrally forming into a rear portion extending upward toward the top end, a toe end divided into a first toe end portion, a second toe end portion, and a third toe end portion, wherein the first toe end portion is adjacent and integrally formed with the top end, the third toe end portion is adjacent and integrally formed with the bottom end, and the second toe end portion is positioned between the first toe end portion and the third toe end portion, and wherein the toe end has a toe ledge extending in a curved manner toward the top rail, the sole, and the heel end, the toe ledge is integrally formed with the top rail wall and the rear portion, a heel end comprising a heel ledge extending in a curved manner toward the top rail, the sole, and toe end wherein the heel ledge is integrally formed with the top rail wall and the rear portion an undercut comprising a first cavity, a second cavity, a third cavity, a fourth cavity, and a fifth cavity, wherein the first cavity is formed between the rear surface and the top rear wall, the first cavity having a first depth ranging from 0.115 inch to 0.135 inch, the second cavity is formed between the rear surface and the rear portion, the second cavity having a second depth ranging from 0.460 inch to 0.580 inch, the third cavity is formed between the rear surface and the toe ledge at the first toe end portion having a third depth ranging from 0.215 inch to 0.245 inch, the fourth cavity is formed between the rear surface and the toe ledge at the second to end portion having a fourth depth ranging from 0.140 inch to 0.165 inch, and the fifth cavity is formed between the rear surface and the heel ledge, the fifth cavity having a fifth depth ranging from 0.080 inch to 0.110 inch.

Clause 12: The golf club head of clause 11 wherein the face element comprises a first thickness, measured perpendicular from a face center of the face surface to the rear center, ranging from 0.088 inch to 0.100 inch, the face element comprises a second thickness, measured perpendicular from face surface to the rear surface adjacent the rear center, ranging from 0.088 inch to 0.100 inch, the face element comprises a third thickness, measured perpendicular from the face surface to the rear surface, adjacent the second thickness, and adjacent the rear perimeter ranging from 0.050 inch to 0.060 inch, and the face element comprises a fourth thickness at the rear perimeter ranging from 0.050 inch to 0.070 inch.

Clause 13: The golf club head of clause 11 wherein the cascading sole comprises a first tier and a second tier.

Clause 14: The golf club head of clause 11 wherein the first tier is proximal to the front end and the second tier is proximal the rear end, and the first tier transitions to the second tier.

Clause 15: The golf club head of clause 11 wherein the first tier comprises a thickness greater than a thickness of the second tier.

Clause 16: The golf club head of clause 11 wherein the first depth of the first cavity is approximately 0.125 inch, the second depth of the second cavity is approximately 0.500 inch, the third depth of the third cavity at the first toe end portion is approximately 0.225 inch, the fourth depth of the fourth cavity at the second toe end portion is approximately 0.120 inch, and the fifth depth of the fifth cavity at the heel end is approximately 0.080 inch.

Clause 17: The golf club head of clause 11 wherein the first cavity, second cavity, third cavity, fourth cavity, and fifth cavity are all integrally connected and continuous.

Clause 18: The golf club head of clause 11 wherein the first cavity, second cavity third cavity, fourth cavity, and fifth cavity are interrupted and non-continuous by an interrupting structure.

Clause 19: The golf club head of clause 11 wherein a weight can be disposed within the second cavity between the rear portion and the rear surface.

Clause 20: The golf club head of clause 11 wherein the toe ledge covers a percentage of the rear surface, wherein the toe ledge is most pronounced at the first toe end portion, decreases toward the second toe end portion, is substantially constant, and slightly increases toward the third toe end portion.

Clause 21: A golf club head comprising a front end, and a rear end, a toe end, and a heel end, a top end having a top rail extending from the toe end to the heel end, a bottom having a sole comprising an inner sole surface, wherein the top rail extends in an arcuate fashion away from the front end, toward the rear end and the bottom end, a face element comprising a face surface located at the front end, a rear surface located at the rear end, opposite to the face surface, the rear surface comprising a rear center, a reinforcement device located at the rear surface, and a recess located between the rear surface of the face element and the top rail define an undercut, the undercut extends along the top rail from the toe end to the heel end, wherein the reinforcement element comprises looped ribs having an outer perimeter surface and an inner perimeter surface, and the outer perimeter surface of the reinforcement element is filleted with the rear surface.

Clause 22: The golf club head of clause 21 further comprising an internal radius transition from the rear surface of the face element to the inner sole surface, the internal radius transition comprises a cascading sole.

Clause 23: The golf club head of claim 22 wherein the cascading sole comprises a first tier and a second tier Clause 24: The golf club head of clause 23 wherein the first tier is proximal to the front end and the second tier is proximal the rear end, and the first tier transitions to the second tier.

Clause 25: The golf club head of clause 23 wherein the first tier comprises a thickness greater than a thickness of the second tier.

Clause 26: The golf club head of clause 21 wherein the looped ribs comprise an elliptical looped rib or a circular looped rib.

Clause 27: The golf club head of clause 21 wherein the looped ribs comprise multiple looped ribs, wherein each looped rib is concentric with each other.

The golf club heads and related methods discussed herein may be implemented in a variety of embodiments, and the foregoing discussion of certain of these embodiments does not necessarily represent a complete description of all possible embodiments. Rather, the detailed description of the drawings, and the drawings themselves, disclose at least one preferred embodiment, and may disclose alternative embodiments.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claim.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A golf club head comprising:

a top end and a bottom end opposite the top end;

a front end and a rear end opposite the front end;

a toe end and a heel end opposite the toe end;

a face element comprising:

a face surface located at the front end and comprising a face center and a face perimeter;

a rear surface located at the rear end and being approximately opposite to the face surface, the rear surface comprising a rear center approximately opposite the face center and a rear perimeter; and a reinforcement element located at the rear surface;

the toe end divided into a first toe end portion, a second toe end portion, and a third toe end portion;

wherein the first toe end portion is adjacent and integrally formed with top end, the third toe end portion is adjacent and integrally formed with the bottom end, and the second toe end portion is positioned between the first toe end portion and the third toe end portion; and wherein the reinforcement element extends out from the rear surface toward the rear end and away from the front end;

wherein the reinforcement element comprises a looped rib having an outer perimeter surface and an inner perimeter surface;

wherein the outer perimeter surface of the reinforcement element is filleted with the rear surface with a fillet having a radius of greater than or equal to 0.012 centimeter;

wherein the inner perimeter surface comprises a largest rib span of greater than or equal to approximately 0.609 centimeters to approximately 1.88 centimeters;

wherein the toe end comprises a toe ledge extending in a curved manner between a top rail and a rear portion, the toe ledge is integrally formed with a top rail wall and the rear portion;

wherein the heel end comprises a heel ledge extending in a curved manner between the top rail and the rear portion, the toe ledge is integrally formed with the top rail wall and the rear portion;

an undercut comprising a first cavity, a second cavity, a third cavity, a fourth cavity, and a fifth cavity;

the first cavity is formed between the rear surface and the top end;

the second cavity is formed between the rear surface and the rear perimeter;

the third cavity is formed between the rear surface and the toe ledge at the first toe end portion;

the fourth cavity is formed between the rear surface and the toe ledge at the second toe end portion; and the fifth cavity is formed between the rear surface and the heel ledge.

2. The golf club head of claim 1, wherein the inner perimeter surface of the looped rib and the rear surface define a cavity; and wherein the cavity is devoid of a weighted insert.

3. The golf club head of claim 1, wherein the inner perimeter surface of the looped rib and the rear surface define a cavity; and wherein the cavity contains an insert.

4. The golf club head of claim 3, further comprises at least one vibration attenuating feature at least partially disposed on the rear surface.

5. The golf club head of claim 4, wherein the at least one vibration attenuating feature comprises at least one layer of a viscoelastic dampening material; and a badge at least partially covering the rear surface of the golf club head; and the badge at least partially covering the cavity.

6. The golf club head of claim 5, wherein the at least one vibration attenuating feature is disposed between the badge and at least one of the rear surface of the golf club head and the cavity.

7. The golf club head of claim 5, wherein the face element is thinner inside the inner perimeter surface than outside the outer perimeter surface.

8. The golf club head of claim 1, wherein:

the first cavity has a first depth ranging from 0.115 inch to 0.135 inch;

the second cavity has a second depth ranging from 0.460 inch to 0.580 inch;

the third cavity has a third depth ranging from 0.215 inch to 0.245 inch;

the fourth cavity has a fourth depth ranging from 0.140 inch to 0.165 inch; and the fifth cavity has a fifth depth ranging from 0.080 inch to 0.110 inch.

9. The golf club head of claim 1, wherein the inner perimeter surface of the looped rib is filleted with the rear surface.

10. The golf club head of claim 1, further comprises a cascading sole at the bottom end of the second cavity; wherein the cascading sole comprises a first tier and a second tier; and wherein a thickness of the first tier is greater than a thickness of the second tier.

11. The golf club head of claim 1, wherein the first cavity, second cavity, third cavity, fourth cavity, and fifth cavity are all integrally connected and continuous.

12. The golf club head of claim 1, wherein the first cavity, second cavity, third cavity, fourth cavity, and fifth cavity are interrupted and non-continuous by an interrupting structure.

13. A golf club head comprising:

a top end and a bottom end opposite the top end;

a front end and a rear end opposite the front end;

a toe end and a heel end opposite the toe end;

a face element comprising:

a face surface located at the front end and comprising a face center and a face perimeter; and a rear surface located at the rear end and being approximately opposite to the face surface, the rear surface comprising a rear center approximately opposite the face center and a rear perimeter; and a reinforcement element located at the rear surface;

the toe end divided into a first toe end portion, a second toe end portion, and a third toe end portion;

wherein the first toe end portion is adjacent and integrally formed with top end, the third toe end portion is adjacent and integrally formed with the bottom end, and the second toe end portion is positioned between the first toe end portion and the third toe end portion; and wherein the reinforcement element extends out from the rear surface toward the rear end and away from the front end;

wherein the reinforcement element comprises a looped rib having an outer perimeter surface and an inner perimeter surface;

wherein the outer perimeter surface of the reinforcement element is filleted with the rear surface with a fillet having a radius of greater than or equal to 0.012 centimeter;

wherein the inner perimeter surface comprises a largest rib span of greater than or equal to approximately 0.609 centimeters to approximately 1.88 centimeters;

wherein the toe end comprises a toe ledge extending in a curved manner between a top rail and a rear portion, the toe ledge is integrally formed with a top rail wall and the rear portion;

wherein the heel end comprises a heel ledge extending in a curved manner between the top rail and the rear portion, the toe ledge is integrally formed with the top rail wall and the rear portion;

an undercut comprising a first cavity, a second cavity, a third cavity, a fourth cavity, and a fifth cavity;

the first cavity is formed between the rear surface and the top end;

the second cavity is formed between the rear surface and the rear perimeter;

the third cavity is formed between the rear surface and the toe ledge at the first toe end portion;

the fourth cavity is formed between the rear surface and the toe ledge at the second toe end portion; and the fifth cavity is formed between the rear surface and the heel ledge;

the inner perimeter surface of the looped rib and the rear surface define a cavity; and the cavity contains an insert.

14. The golf club head of claim 13, wherein:

the first cavity has a first depth ranging from 0.115 inch to 0.135 inch;

the second cavity has a second depth ranging from 0.460 inch to 0.580 inch;

the third cavity has a third depth ranging from 0.215 inch to 0.245 inch;

the fourth cavity has a fourth depth ranging from 0.140 inch to 0.165 inch; and the fifth cavity has a fifth depth ranging from 0.080 inch to 0.110 inch.

15. The golf club head of claim 13, wherein the inner perimeter surface of the looped rib is filleted with the rear surface.

16. The golf club head of claim 13, wherein the face element is thinner inside the inner perimeter surface than outside the outer perimeter surface.

17. The golf club head of claim 13, further comprises a cascading sole at the bottom end of the second cavity; and wherein the cascading sole comprises a first tier and a second tier.

18. The golf club head of claim 17, wherein a thickness of the first tier is greater than a thickness of the second tier.

19. The golf club head of claim 13, wherein the first cavity, second cavity, third cavity, fourth cavity, and fifth cavity are all integrally connected and continuous.

20. The golf club head of claim 13, wherein the first cavity, second cavity, third cavity, fourth cavity, and fifth cavity are interrupted and non-continuous by an interrupting structure.

* * * * *